US008651631B2

(12) United States Patent
Koseki

(10) Patent No.: US 8,651,631 B2
(45) Date of Patent: Feb. 18, 2014

(54) LIQUID JET HEAD, LIQUID JET APPARATUS, AND METHOD OF MANUFACTURING LIQUID JET HEAD

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 13/534,142

(22) Filed: Jun. 27, 2012

(65) Prior Publication Data

US 2013/0002766 A1 Jan. 3, 2013

(30) Foreign Application Priority Data

Jun. 28, 2011 (JP) ..... 2011-143201
Jan. 16, 2012 (JP) ..... 2012-006475

(51) Int. Cl.
*B41J 2/045* (2006.01)
*B41J 2/16* (2006.01)

(52) U.S. Cl.
USPC ..... 347/71; 347/50; 347/65; 347/68

(58) Field of Classification Search
USPC ..... 347/50, 65, 68, 71
See application file for complete search history.

(56) References Cited

U.S. PATENT DOCUMENTS

| | | | | |
|---|---|---|---|---|
| 4,047,186 | A * | 9/1977 | Kendall et al. | 347/47 |
| 4,364,067 | A * | 12/1982 | Koto et al. | 347/70 |
| 2002/0012029 | A1* | 1/2002 | Miyata | 347/68 |
| 2003/0025767 | A1* | 2/2003 | Sakamoto et al. | 347/68 |
| 2003/0043238 | A1* | 3/2003 | Yoshizawa et al. | 347/68 |
| 2003/0193550 | A1* | 10/2003 | Harajiri et al. | 347/68 |
| 2010/0026760 | A1 | 2/2010 | Matsuo | 347/47 |
| 2011/0109703 | A1* | 5/2011 | Koseki | 347/71 |
| 2013/0002769 | A1* | 1/2013 | Koseki | 347/71 |

FOREIGN PATENT DOCUMENTS

| | | |
|---|---|---|
| EP | 0600743 | 6/1994 |
| EP | 2130677 | 12/2009 |
| EP | 2316649 | 5/2011 |
| JP | 2009196122 | 9/2009 |

* cited by examiner

*Primary Examiner* — Matthew Luu
*Assistant Examiner* — Alexander D Shenderov
(74) *Attorney, Agent, or Firm* — Adams & Wilks

(57) ABSTRACT

A liquid jet head has side walls forming grooves and drive electrodes formed on wall surfaces of the side walls. A reinforcing plate includes through holes communicating with the grooves and being elongated in a longitudinal direction of the grooves. A nozzle plate includes nozzles communicating with the through holes of the reinforcing plate. A cover plate has a supply port for supplying liquid to the grooves and a discharge port for discharging liquid from the grooves.

20 Claims, 12 Drawing Sheets

LIQUID JET HEAD, LIQUID JET APPARATUS, AND METHOD OF MANUFACTURING LIQUID JET HEAD

BACKGROUND OF THE INVENTION

1. Field of the Invention

The present invention relates to a liquid jet head for ejecting a liquid from a nozzle to form images, characters, or a thin film material onto a recording medium. The present invention relates also to a liquid jet apparatus using the liquid jet head, and to a method of manufacturing a liquid jet head.

2. Description of the Related Art

In recent years, there has been used an ink-jet type liquid jet head for ejecting ink droplets on recording paper or the like to render characters or graphics thereon, or for ejecting a liquid material on a surface of an element substrate to form a functional thin film thereon. In such a liquid jet head, ink or a liquid material is supplied from a liquid tank via a supply tube to the liquid jet head, and ink or a liquid material filled into a channel is ejected from a nozzle which communicates with the channel. When ink is ejected, the liquid jet head or a recording medium on which a pattern of jetted liquid is to be recorded is moved to render a character or a graphics, or to form a functional thin film in a predetermined shape.

Japanese Patent Application Laid-open No. 2009-196122 describes an ink jet head 60 in which ink channels which are a large number of grooves are formed in a sheet formed of a piezoelectric material. FIG. 14 is a sectional view of the ink jet head 60 illustrated in FIG. 2 of Japanese Patent Application Laid-open No. 2009-196122. The ink jet head 60 has a laminated structure of a substrate 62, a piezoelectric member 65, and a cover member 64. Supply ports 81 are formed in the middle of the substrate 62 and discharge ports 82 are formed so as to sandwich the supply ports 81. The piezoelectric member 65 and a frame member 63 are adhered to a front surface of the substrate 62, and the cover member 64 is adhered to an upper surface thereof.

The piezoelectric member 65 is formed by adhering together two piezoelectric plates 73 in which the directions of polarization are opposite to each other. A plurality of minute grooves which extend in a sub-scanning direction (in a direction in parallel with the drawing sheet) are formed by cutting in the piezoelectric member 65, and a plurality of pressure chambers 74 which are arranged at regular intervals in a main scanning direction (in a direction perpendicular to the drawing sheet) are formed. Each of the pressure chambers 74 (channels) is defined by a pair of adjacent walls 75. An electrode 76 is formed continuously on opposing side surfaces of the pair of walls 75 and a bottom portion therebetween, and further, is electrically connected to ICs 66 via electric wiring 77 formed on the front surface of the substrate 62. The cover member 64 is formed by adhering a film 92 and a reinforcing member 94 together via an adhesive. The cover member 64 is adhered to the piezoelectric member 65 and the frame member 63 under a state in which the reinforcing member 94 is on the piezoelectric member 65 side. Openings 96 and nozzles 72 which correspond to the pressure chambers 74 are formed in the reinforcing member 94 and in the film 92, respectively.

Ink is supplied from the supply ports 81 in the middle of the substrate 62, and flows to the plurality of pressure chambers 74 and then to an ink chamber 90 to be discharged from the discharge ports 82. When a drive pulse is applied from the ICs 66 via the electric wiring 77 to the electrode 76 on the pair of walls 75 sandwiching the pressure chamber 74, the pair of walls 75 undergo shear mode deformation and bend so as to be spaced away from each other, and then return to their initial positions to increase the pressure in the pressure chamber 74, which is accompanied by ejection of an ink droplet from the corresponding nozzle 72.

Here, as the film 92 of the cover member 64, a polyimide film is used, and, as the reinforcing member 94, a metal foil of, for example, SUS, Ni, Ti, or Cr is used. If the cover member 64 is the single layer polyimide film 92, the nozzles 72 may be formed easily in such a polyimide film by a laser, but the stiffness of such a polyimide film is lower than that of a metal or the like, and thus, when the walls 75 undergo shear mode deformation, the film is extended. Therefore, pressure cannot be transferred efficiently to ink filled into the pressure chambers 74. Accordingly, as the cover member 64, the polyimide film 92 and the metal foil having a stiffness higher than that of the polyimide film 92 are adhered together. This enables fixing of upper ends of the walls 75 when the walls 75 undergo shear mode deformation, and pressure loss when an ink droplet is ejected may be eliminated. Note that, the polyimide film 92 has a thickness of 50 μm and the metal foil as the reinforcing member 94 has a thickness of 50 μm to 100 μm. Further, in order to prevent a short circuit between the electrode 76 formed on wall surfaces of the walls 75 and the metal foil as the reinforcing member 94, an $SiO_2$ film 95 is formed on a surface of the metal foil on the electrode 76 side.

However, an ejection surface of an ink jet head ordinarily has a length of several tens of millimeters or more. A metal foil having a thickness of 50 μm to 100 μm and having an outside diameter of several tens of millimeters or more is liable to suffer warping and is difficult to adhere in a flat state to upper end surfaces of the walls 75 via an adhesive. Further, it is also difficult to prevent warping when the polyimide film 92 having a thickness of 50 μm and this metal foil are adhered together via an adhesive.

Accordingly, a method is conceived in which a thick metal plate is first adhered to the upper end surfaces of the walls 75 and then the metal plate is ground to the above-mentioned thickness to be a metal foil. In this case, the openings 96 are in advance formed in the metal plate, and the metal plate is ground to be a thin film. However, if the metal plate is ground, ends of the openings 96 are deformed or a burr is formed thereat and the shape of the openings 96 may not be maintained. Further, if the reinforcing member 94 is formed of a metal material, such a metal material causes a short circuit with the electrodes 76 formed on the wall surfaces of the walls 75. In order to prevent this, it is necessary to form the $SiO_2$ film 95 on the surface of the metal material, which increases the number of steps to increase the cost. Further, the metal foil as the reinforcing member 94 is in contact with ink. Therefore, if corrosive ink is used, the metal material may be corroded to reduce the durability of the ink jet head.

SUMMARY OF THE INVENTION

The present invention has been made in view of the above-mentioned problems, and an object of the present invention is to provide a highly reliable liquid jet head in which a reinforcing member may be easily bonded.

A liquid jet head according to an exemplary embodiment of the present invention includes: side walls forming grooves; a reinforcing plate including through holes communicating with the grooves, the reinforcing plate being formed of a ceramic material and placed below the side walls; a nozzle plate including nozzles which are open to the through holes, the nozzle plate being placed on the reinforcing plate on a side opposite to the side walls; drive electrodes formed on wall surfaces of the side walls; and a cover plate placed above the side walls, the cover plate including: a supply port for supplying liquid to the grooves; and a discharge port for discharging liquid from the grooves.

Further, the ceramic material includes machinable ceramic.

Further, the cover plate is placed on upper surfaces of the side walls under a state in which upper surface ends in a longitudinal direction of the side walls are exposed. The liquid jet head further includes extracting electrodes formed on the upper surface ends, the extracting electrodes being electrically connected to the drive electrodes.

Further, the liquid jet head further includes a flexible substrate having wiring electrodes formed on a surface thereof. The flexible substrate is bonded to the upper surface ends and the wiring electrodes are electrically connected to the extracting electrodes.

Further, the liquid jet head further includes sealing materials for closing the grooves outside communicating portions between the grooves and the supply port and between the grooves and the discharge port.

Further, the grooves include: ejection grooves for ejecting liquid; and dummy grooves which avoid ejecting liquid. The ejection grooves and the dummy grooves are arranged alternately.

Further, the supply port and the discharge port are open to the ejection grooves and are closed to the dummy grooves.

A liquid jet apparatus according to another exemplary embodiment of the present invention includes: the liquid jet head according to the exemplary embodiment of the present invention; a moving mechanism for reciprocating the liquid jet head; a liquid supply tube for supplying liquid to the liquid jet head; and a liquid tank for supplying the liquid to the liquid supply tube.

A method of manufacturing a liquid jet head according to a further exemplary embodiment of the present invention includes: forming grooves which are formed by side walls in a front surface of a substrate, the substrate including a piezoelectric material; forming a conductive film by depositing a conductor on the substrate; forming electrodes by patterning the conductive film; bonding a cover plate on upper surfaces of the side walls, the cover plate including: a supply port for supplying liquid to the grooves; and a discharge port for discharging liquid from the grooves; grinding a rear surface of the substrate to cause the grooves open to the rear surface side; bonding a reinforcing plate to lower surfaces of the side walls, the reinforcing plate being formed of a ceramic material; and bonding a nozzle plate to the reinforcing plate.

Further, the method further includes grinding the reinforcing plate, in which the grinding the reinforcing plate succeeds the bonding a reinforcing plate.

Further, the method further includes forming a spot facing portion on a surface of the reinforcing plate on a side opposite to the side walls, in which the forming a spot facing portion precedes the grinding the reinforcing plate.

Further, the method further includes forming nozzles for ejecting liquid in the nozzle plate at locations between the supply port and the discharge port.

Further, the forming electrodes includes: forming drive electrodes on wall surfaces of the side walls; and forming extracting electrodes on upper surface ends in a longitudinal direction of the side walls, the extracting electrodes being electrically connected to the drive electrodes.

Further, the method further includes bonding, to the upper surface ends, a flexible substrate having wiring electrodes formed thereon to electrically connect the wiring electrodes to the extracting electrodes.

The liquid jet head according to the exemplary embodiment of the present invention includes: side walls forming grooves; a reinforcing plate including through holes communicating with the grooves, the reinforcing plate being formed of a ceramic material and placed below the side walls; a nozzle plate including nozzles which are open to the through holes, the nozzle plate being placed on the reinforcing plate on a side opposite to the side walls; drive electrodes formed on wall surfaces of the side walls; and a cover plate placed above the side walls, the cover plate including: a supply port for supplying liquid to the grooves; and a discharge port for discharging liquid from the grooves. The ceramic material is used as the reinforcing plate, and thus, a liquid jet head may be provided, which may improve the conversion efficiency in converting deformation of a side wall into pressure fluctuations of liquid, which may prevent leakage of a drive signal via liquid and the reinforcing plate, and in which the durability thereof is not reduced even when corrosive ink is used due to high corrosion resistance of the ceramic material.

DETAILED DESCRIPTION OF THE PREFERRED EMBODIMENTS

Liquid Jet Head

First Embodiment

Figure 1A:
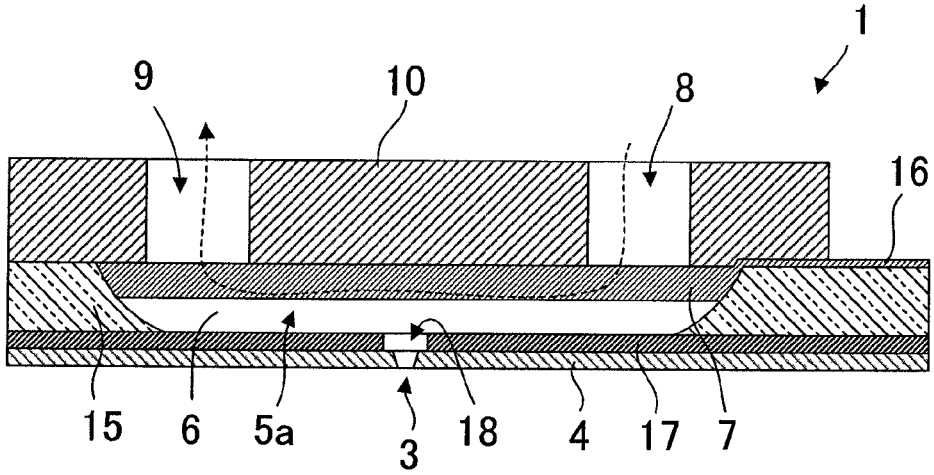
FIGS. 1A and 1B are schematic vertical sectional views of a liquid jet head according to a first embodiment of the present invention.
Figure 1B:
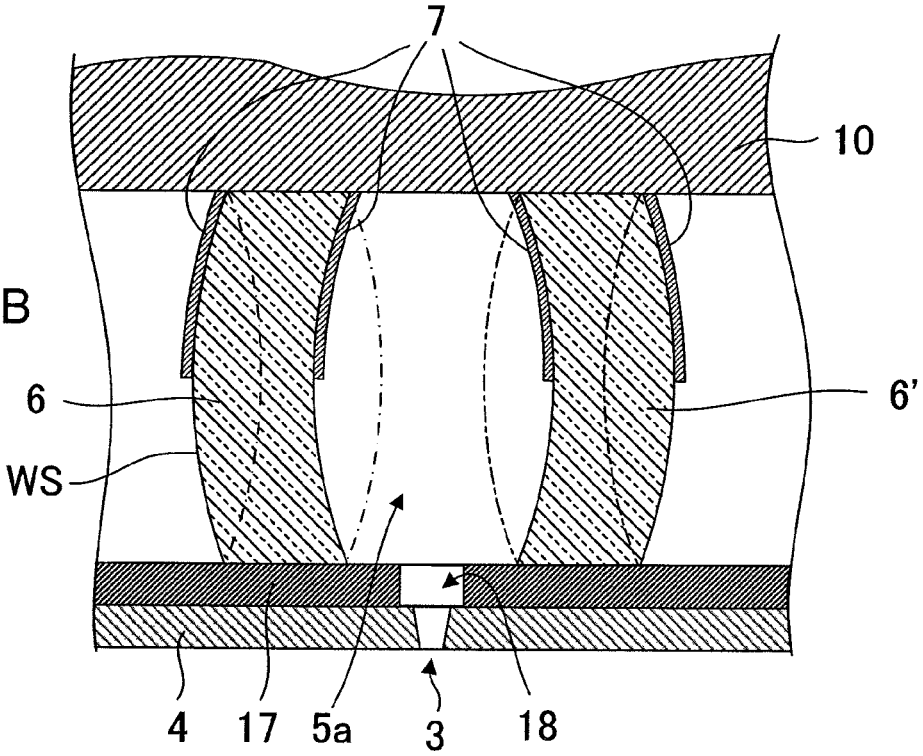

FIGS. 1A and 1B are schematic vertical sectional views of a liquid jet head 1 according to a first embodiment of the present invention, and illustrate a basic structure of the liquid jet head 1 according to the present invention. FIG. 1A is a sectional view in a direction along an ejection groove 5*a* while FIG. 1B is a sectional view in a direction orthogonal to the ejection grooves 5*a*. As illustrated in FIGS. 1A and 1B, the liquid jet head 1 includes a plurality of side walls 6 and 6', a reinforcing plate 17 placed below the plurality of side walls 6 and 6', a nozzle plate 4 placed on a side opposite to the side walls 6 and 6' with respect to the reinforcing plate 17, drive electrodes 7 formed on wall surfaces WS of the plurality of side walls 6 and 6', and a cover plate 10 placed above the side walls 6 and 6'.

Two side walls 6 and 6' form an ejection groove 5*a*. Each of the side walls 6 and 6' is entirely or partially formed of a piezoelectric body which is polarized in a vertical direction with respect to a substrate surface of the reinforcing plate 17. The drive electrodes 7 are formed on upper halves of the side walls 6 so as to sandwich the side walls 6, respectively. The reinforcing plate 17 is formed of a ceramic material and has through holes 18 formed therein for communicating with the ejection grooves 5*a*, respectively. The nozzle plate 4 includes nozzles 3 which are open to the through holes 18, respectively, in the reinforcing plate 17. The cover plate 10 includes a supply port 8 for supplying liquid such as ink to the ejection grooves 5*a* and a discharge port 9 for discharging liquid from the ejection grooves 5*a*.

Further, the cover plate 10 is bonded to upper surfaces of the side walls 6 and 6' so as to close upper openings of the ejection grooves 5*a* and so as to expose one upper surface ends. Extracting electrodes 16 electrically connected to the drive electrodes 7 are formed on the upper surface ends of the side walls 6 and 6'. The through holes 18 and the nozzles 3 are located substantially in the middle between the supply port 8 and the discharge port 9 in a longitudinal direction of the ejection grooves 5*a*. Note that, formation of the extracting electrodes 16 on the upper surface ends of the side walls 6 and 6' under a state in which the extracting electrodes 16 are exposed and formation of the nozzles 3 and the through holes 18 substantially in the middle between the supply port 8 and the discharge port 9 are not essential for the present invention.

Operation of the liquid jet head 1 is as follows. Liquid such as ink is supplied from a liquid tank (not shown) to the supply port 8, flows into the ejection grooves 5*a*, and is discharged via the discharge port 9 to the liquid tank. In other words, liquid is circulated and is supplied to the ejection grooves 5*a*. When a drive signal is applied to the drive electrodes 7 which sandwich the side wall 6 and the side wall 6', respectively, the two side walls 6 and 6' undergo thickness shear deformation and bend with respect to a vertical direction. The two side walls 6 and 6' are first displaced away from each other as indicated by solid lines to increase the capacity of the ejection groove 5*a*, thereby pulling liquid into the ejection groove 5*a*. Then, the two side walls 6 and 6' return to their initial positions, or, are displaced closer to each other as indicated by dot-and-dash lines to decrease the capacity of the ejection groove 5*a*, thereby ejecting a liquid droplet through the corresponding nozzle 3. In this case, the reinforcing plate 17 is placed on lower end surfaces of the two side walls 6 and 6', and thus, lower ends of the side walls 6 and 6' are fixed more firmly than in a case without the reinforcing plate 17. Thus, the capacity of the ejection groove 5*a* changes more greatly. Therefore, the conversion efficiency in converting thickness shear deformation of the side walls 6 and 6' into pressure fluctuations of liquid in the ejection grooves 5*a* is improved.

Here, as a piezoelectric substrate 15, PZT ceramic which is polarized in the vertical direction of the substrate surface is used. The ejection groove 5*a* is in the shape of a boat under a state in which ends thereof in the longitudinal direction are inclined. As the nozzle plate 4, a polyimide film is used. As the cover plate 10, the same material as that of the piezoelectric substrate 15 is used. Accordingly, the thermal expansion coefficient of the cover plate 10 and the thermal expansion coefficient of the piezoelectric substrate 15 become equal to each other, and the reliability against temperature change may be improved.

As the reinforcing plate 17, a ceramic material such as machinable ceramic, PZT ceramic, silicon oxide, aluminum oxide (alumina), or aluminum nitride may be used. As machinable ceramic, for example, Macerite, Macor, Photoveel, or Shapal (all registered trademarks) may be used. Even when through holes are formed in advance in a ceramic material, the shape of the openings of the through holes is not deformed by grinding. When an insulating material is used, an insulating film for preventing a short circuit is not required to be formed. Further, a ceramic material is highly resistant to corrosion, and thus, the range of the kinds of usable liquid is wide. Even if, for example, corrosive water-based ink is used, the durability is not reduced. In particular, machinable ceramic is easily ground, and in addition, the thermal expansion coefficient thereof may be set similar to that of the piezoelectric substrate 15, in this case, of PZT ceramic. Therefore, the highly reliable liquid jet head 1 in which the piezoelectric substrate 15 does not suffer warping and is not broken when the temperature changes may be formed.

Second Embodiment

Figure 2:
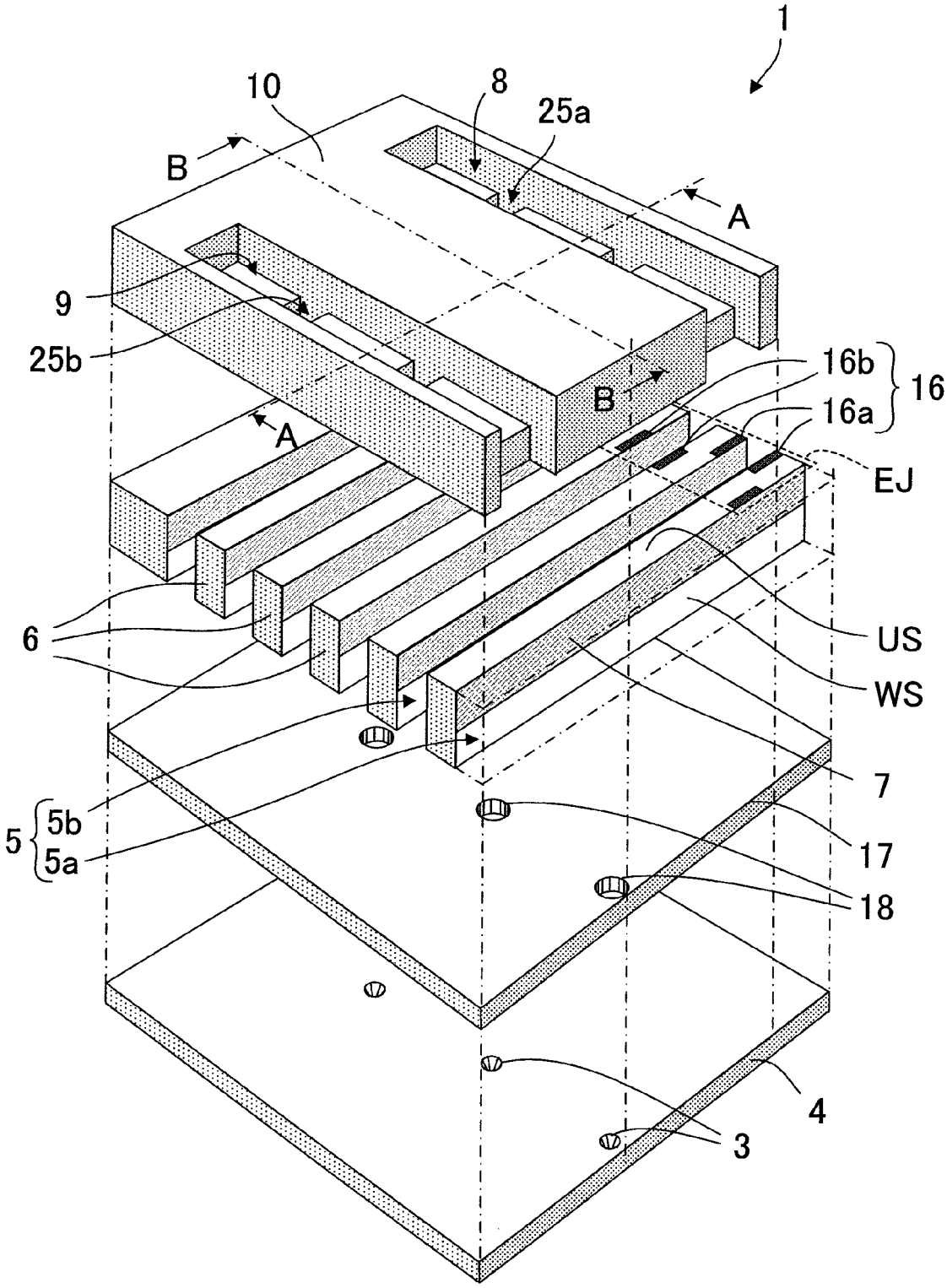
FIG. 2 is a schematic exploded perspective view of a liquid jet head according to a second embodiment of the present invention.
Figure 3:
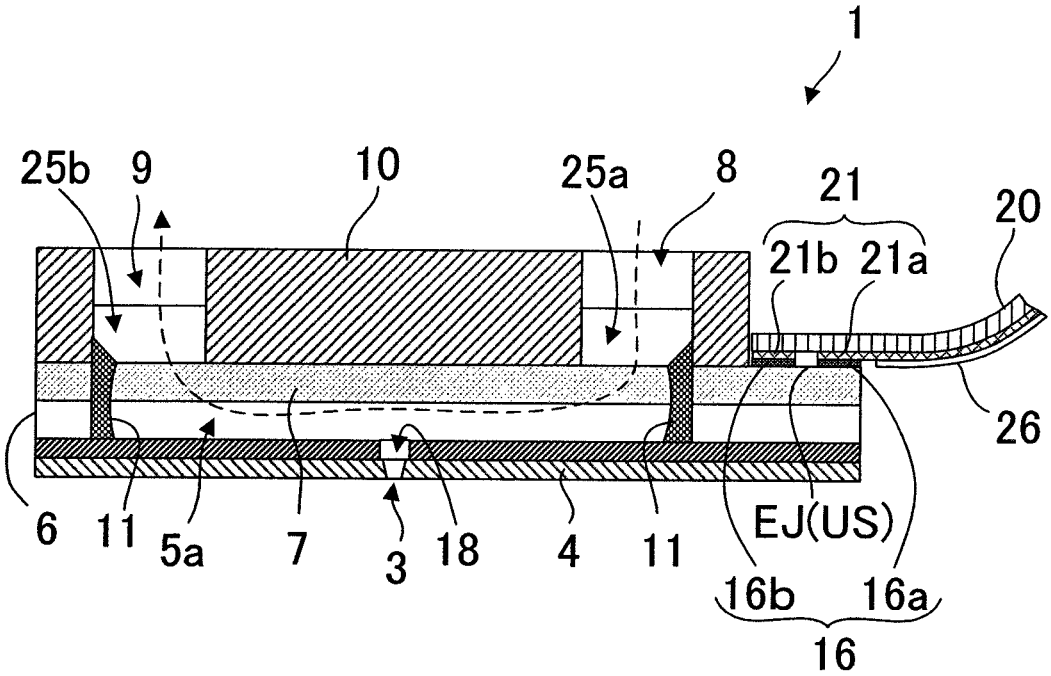
FIG. 3 is a schematic vertical sectional view taken along the line A-A of FIG. 2.
Figure 4:
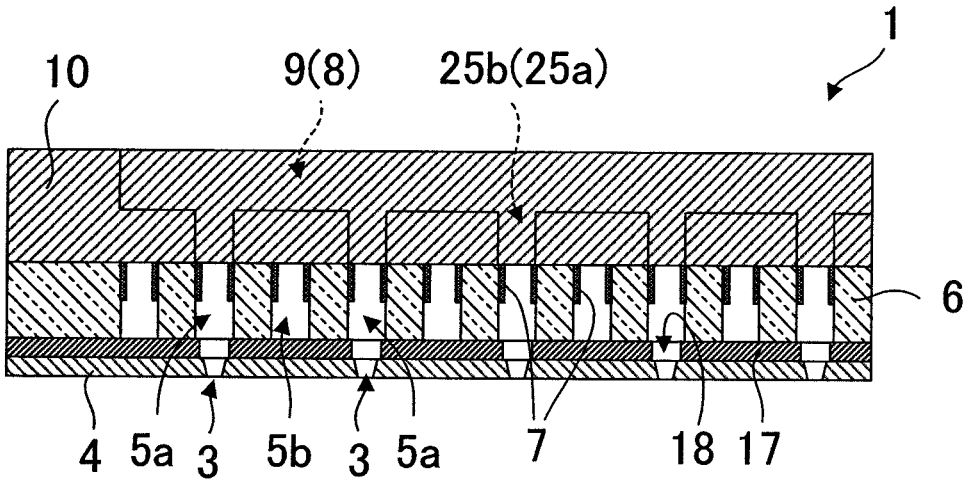
FIG. 4 is a schematic vertical sectional view taken along the line B-B of FIG. 2.

FIG. 2 to FIG. 4 illustrate a liquid jet head 1 according to a second embodiment of the present invention. FIG. 2 is a schematic exploded perspective view of the liquid jet head 1, FIG. 3 is a schematic vertical sectional view taken along the line A-A of FIG. 2, and FIG. 4 is a schematic vertical sectional view taken along the line B-B of FIG. 2. Note that, in FIG. 3, a flexible substrate 20 bonded to upper surface ends EJ of the side walls 6 is additionally illustrated. Further, the line A-A of FIG. 2 is located above slits 25*a* and 25*b* to be described later.

The liquid jet head 1 has a laminated structure in which the nozzle plate 4, the reinforcing plate 17 formed of a ceramic material, the plurality of side walls 6 placed in parallel with one another, and the cover plate 10 are laminated. The nozzle plate 4 includes the nozzles 3 for ejecting liquid therethrough. The reinforcing plate 17 includes the through holes 18 at locations corresponding to the nozzles 3, respectively. The plurality of side walls 6 are arranged so as to be in parallel with one another above the reinforcing plate 17 to form a plurality of grooves 5 having a fixed depth. Each of the side walls 6 is entirely or partially formed of piezoelectric ceramic which is formed of a piezoelectric material, for example, lead zirconate titanate (PZT). The piezoelectric ceramic is polarized, for example, in a vertical direction. The drive electrode 7 for applying an electric field to the piezoelectric material of the side wall 6 to selectively deform the side wall 6 is formed on the wall surface WS of each of the side walls 6. The cover plate 10 is placed on upper surfaces US of the plurality of side walls 6, and includes the supply port 8 for supplying liquid to the plurality of grooves 5 and the discharge port 9 for discharging liquid from the grooves 5. The cover plate 10 is placed on the upper surfaces US of the side walls 6 under a state in which the upper surface ends EJ in the longitudinal direction of the plurality of side walls 6 are exposed.

The plurality of grooves 5 include ejection grooves 5*a* into which liquid is filled and dummy grooves 5*b* into which liquid is not filled. The ejection grooves 5*a* and the dummy grooves 5*b* are alternately arranged in parallel with one another. The slits 25*a* and 25*b* are formed in the supply port 8 and the discharge port 9, respectively. The supply port 8 and the ejection grooves 5*a* communicate with each other via the slits 25*a* while the ejection grooves 5*a* and the discharge port 9 communicate with each other via the slits 25*b*. The supply port 8 and the discharge port 9 are closed to the dummy grooves 5*b*. Further, sealing materials 11 are placed for sealing the ejection grooves 5*a* outside communicating portions between the ejection grooves 5*a* and the supply port 8 and between the ejection grooves 5*a* and the discharge port 9, respectively. As illustrated in FIG. 3, the sealing materials 11 are formed so as to close the ejection grooves 5*a* and so as to reach the slits 25*a* and 25*b*, respectively. Therefore, liquid supplied to the supply port 8 is supplied via the slits 25*a* to the ejection grooves 5*a*, and further, is discharged via the slits 25*b* to the discharge port 9, and does not leak to the outside. On the other hand, the dummy grooves 5*b* are closed to the supply port 8 and the discharge port 9, and thus, liquid is not filled into the dummy grooves 5*b*. The through holes 18 and the nozzles 3 are located substantially in the middle between the supply port 8 and the discharge port 9, and communicate with the ejection grooves 5*a*, respectively. It does not matter whether or not additional nozzles 3 are formed correspondingly to the dummy grooves 5*b*. In this embodiment, in order to reduce the number of process steps, the nozzles 3 are not formed correspondingly to the dummy grooves 5*b*.

The drive electrode 7 is located at an upper half of the wall surface WS of the side wall 6 and is provided so as to extend to ends in the longitudinal direction of the side wall 6. The extracting electrodes 16 are formed on the upper surface end EJ of each of the side walls 6. The extracting electrodes 16 include common extracting electrodes 16*b* electrically connected to the drive electrodes 7 formed on the wall surfaces WS of the side walls 6 forming the ejection grooves 5*a*, and individual extracting electrodes 16*a* electrically connected to the drive electrodes 7 formed on the wall surfaces WS forming the dummy grooves 5*b*. The individual extracting electrodes 16*a* are placed on an end side of the upper surface ends EJ of the side walls 6, while the common extracting electrodes 16*b* are placed on the cover plate 10 side of the upper surface ends EJ of the side walls 6.

As illustrated in FIG. 3, the flexible substrate 20 is bonded to the upper surface ends EJ of the side walls 6. Wiring electrodes 21 are formed on a lower surface of the flexible substrate 20 and are connected to a drive circuit (not shown). The wiring electrodes 21 include a common wiring electrode 21*b* electrically connected to the common extracting electrodes 16*b* and individual wiring electrodes 21*a* electrically connected to corresponding individual extracting electrodes 16*a*. A protective film 26 is formed on a surface of the wiring electrodes 21 on the flexible substrate 20 except for bonded surfaces thereof to prevent occurrence of a short circuit and the like.

Operation of the liquid jet head 1 is as follows. Liquid such as ink is supplied from a liquid tank or the like (not shown) to the supply port 8. The supplied liquid flows via the slits 25*a* into the ejection grooves 5*a* and flows via the slits 25*b* out to the discharge port 9 to be discharged to the liquid tank or the like (not shown). A drive signal is applied to the individual wiring electrode 21*a* and the common wiring electrode 21*b*. When there is a potential difference between one drive electrode 7 and the other drive electrode 7 which sandwich the side wall 6, the side wall 6 undergoes thickness shear deformation so that the capacity of the ejection groove 5*a* is instantaneously changed and pressure is applied to liquid which is filled thereinto, with the result that a liquid droplet is ejected through a corresponding nozzle 3. For example, in a pull-ejection method, the capacity of the ejection groove 5*a* is once increased to pull liquid thereinto from the supply port 8, and then the capacity of the ejection groove 5*a* is decreased to eject liquid through the nozzle 3. The liquid jet head 1 and a recording medium therebelow are moved to render an image on the recording medium with liquid droplets for recording.

The reinforcing plate 17 formed of a ceramic material is placed between the plurality of side walls 6 and the nozzle plate 4, and thus, the conversion efficiency in converting deformation of the side walls 6 into pressure fluctuations of liquid in the ejection grooves 5*a* is improved. Further, if an insulating ceramic material is used, even when conductive liquid is used, a drive signal does not leak via the reinforcing plate 17, and, even when corrosive liquid is used, the durability is not reduced. Further, the thermal expansion coefficient of the ceramic material may be set similar to that of PZT ceramic of the side walls 6, and the highly reliable liquid jet head 1 which does not suffer warping and is not broken when the temperature changes may be provided.

According to this embodiment, the depth of the grooves 5 formed between the side walls 6, respectively, is fixed, and the ejection grooves 5*a* outside the communicating portions with the supply port 8 and with the discharge port 9 are closed by the sealing materials 11, respectively. As a result, the outside shape of the disc-like dicing blade (also referred to as "diamond wheel") used in forming the grooves 5 by grinding may be prevented from being reflected on the piezoelectric body or the substrate to cause dead spaces, and the width in the longitudinal direction of the grooves 5 in the liquid jet head 1 may be significantly reduced. For example, when the depth of the grooves 5 is 350 μm, the width of the liquid jet head 1 may be reduced by 8 mm to 12 mm compared with a case of a conventional method, and the number of sheets obtained from a piezoelectric substrate of the same size becomes larger, which reduces the cost.

Further, the sealing materials 11 are formed inside the slits 25*a* and 25*b* so as to reach the wall surfaces of the slits 25*a* and 25*b*, respectively, and the sealing materials 11 are inclined with respect to the wall surfaces of the slits 25*a* and 25*b*. As a result, stagnation regions of liquid may be reduced. More specifically, the stagnation regions in which liquid stagnates and air bubbles and foreign matter in liquid remain for a long time are small in the ejection grooves 5*a*, the supply port 8, and the discharge port 9. For example, when air bubbles stagnate in the ejection groove 5*a*, a pressure wave for ejecting liquid is absorbed in the air bubbles, and a liquid droplet cannot be properly ejected through the nozzle. When such failure is caused, it is necessary to promptly discharge the air bubbles from within the channel. According to this embodiment, such stagnation regions are small, and thus, the air bubbles may be promptly discharged.

Figure 14:
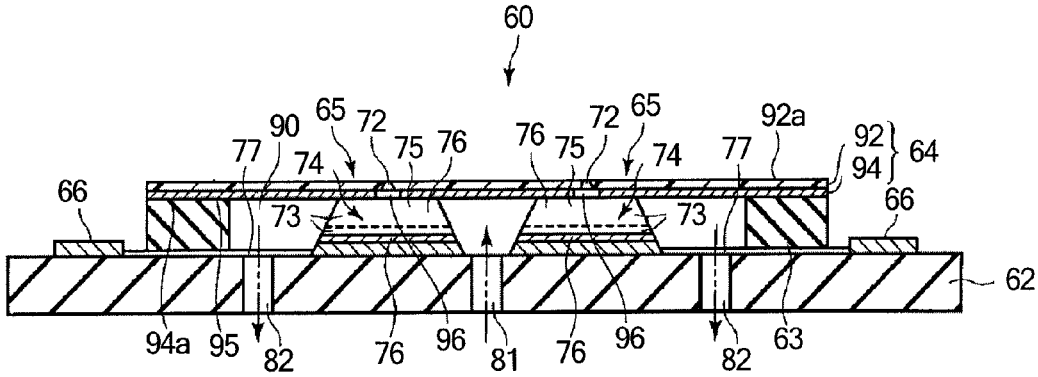
FIG. 14 is a sectional view of a conventionally known ink jet head.

Further, in the conventional case illustrated in FIG. 14, the pressure chambers 74 and the ICs 66 are formed on the same surface of the substrate 62, and thus, the height of the ICs 66 is limited so that the upper surfaces thereof are prevented from extending off the ejection surface of the cover member 64. On the other hand, according to this embodiment, the flexible substrate 20 is bonded to the upper surface ends EJ which are a part of the upper surfaces US of the side walls 6, and the nozzle plate 4 is bonded to the opposite side of the side walls 6 so that liquid is ejected to the side opposite to the side on which the flexible substrate 20 is bonded. As a result, there is no limitation on the height of the bonded portion of the flexible substrate 20, and not only the flexible substrate 20 may be easily bonded to the upper surfaces US of the side walls 6 but also the design flexibility increases.

Further, in the conventional case illustrated in FIG. 14, ink flows into all the pressure chambers 74, and the electrodes 76 and the electric wiring 77 on the substrate 62 are brought into contact with ink, and thus, if conductive ink is used, a drive signal leaks or an electrode undergoes electrolysis. In order to prevent this, it is necessary to cover all the electrodes 76 and the electric wiring 77 with a protective film such as an oxide film. On the other hand, according to this embodiment, the ejection grooves 5*a* and the dummy grooves 5*b* are alternately arranged so as to be in parallel with one another, and liquid is filled into the ejection grooves 5*a*, while liquid is not filled into the dummy grooves 5*b*. In driving, all the drive electrodes 7 on the ejection groove 5*a* side are connected to a GND in common and a drive signal is selectively applied to the drive electrodes 7 on the dummy groove 5*b* side. This may prevent leakage of a drive signal even if liquid which is used is conductive, and bipolar voltage is not applied to liquid, with the result that the durability of the electrodes is improved.

Note that, as the cover plate 10, a plastic, ceramic, or the like may be used, but when the same material as that of the side walls 6, for example, PZT ceramic, is used, the thermal expansion coefficient of the cover plate 10 is equal to that of the side walls 6, which enables improvement in durability to withstand thermal change. As the nozzle plate 4, a plastic material, a metal material, ceramic, or the like may be used. When a polyimide material is used as the nozzle plate 4, laser drilling to form the nozzles 3 is facilitated.

Further, in this embodiment, the sealing materials 11 are placed in the ejection grooves 5*a* on the supply port 8 side and on the discharge port 9 side, respectively, but the present invention is not limited thereto. The sealing materials 11 may be caused to flow into the ejection grooves 5*a* from both end sides of the cover plate 10 to fill the sealing materials 11 into the ejection grooves 5*a* outside the supply port 8 and the discharge port 9, respectively, in the cover plate 10.

Third Embodiment

Figure 5:
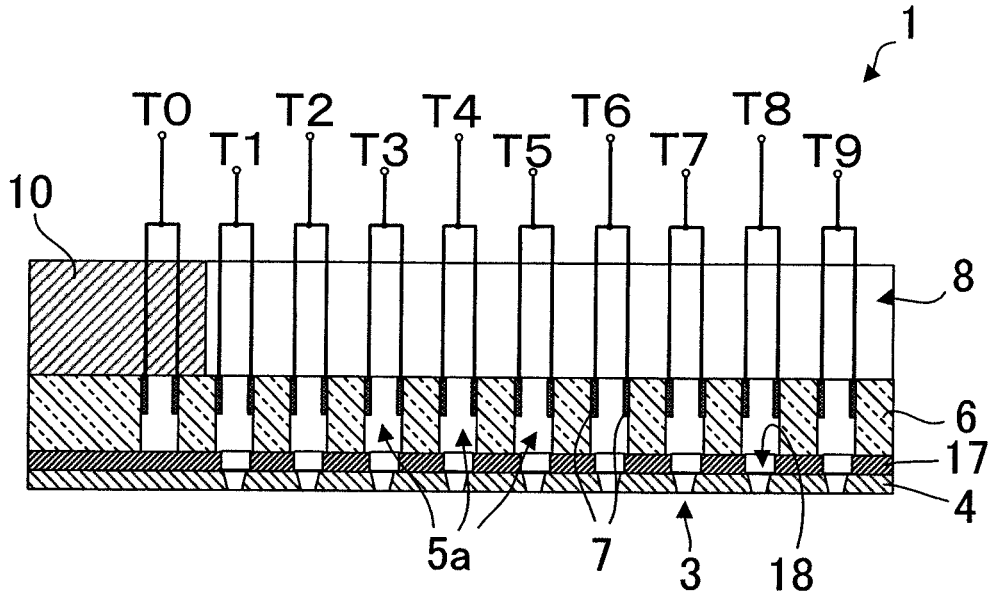
FIG. 5 is an explanatory diagram of a liquid jet head according to a third embodiment of the present invention.

FIG. 5 illustrates a liquid jet head 1 according to a third embodiment of the present invention, and is an explanatory diagram in which electrode wiring is added to a vertical section taken in the longitudinal direction of the supply port 8. This embodiment is different from the second embodiment in that all the grooves 5 except those at both ends are the ejection grooves 5*a*. Accordingly, the supply port 8 and the discharge port (not shown) in the cover plate 10 which is placed above the side walls 6 communicate with all the ejection grooves 5*a*. Further, the reinforcing plate 17 and the nozzle plate 4 placed under the side walls 6 have the through holes 18 and the nozzles 3 which communicate with the ejection grooves 5*a*, respectively. The through holes 18 and the nozzles 3 are located substantially in the middle between the supply port and the discharge port in the longitudinal direction of the ejection grooves 5*a*. Terminals T0 to T9 are each electrically connected to the drive electrodes 7 formed on both wall surfaces of corresponding ejection grooves 5*a*.

The liquid jet head 1 ejects liquid droplets in accordance with a three-cycle drive system. More specifically, a drive signal is applied between the terminal T1 and the terminal T0 and between the terminal T1 and the terminal T2 to cause liquid to be ejected from the ejection groove 5*a* corresponding to the terminal T1. Then, a drive signal is applied between the terminal T2 and the terminal T1 and between the terminal T2 and the terminal T3 to cause liquid to be ejected from the ejection groove 5*a* corresponding to the terminal T2. Then, a drive signal is applied between the terminal T3 and the terminal T2 and between the terminal T3 and the terminal T4 to cause liquid to be ejected from the ejection groove 5*a* corresponding to the terminal T3. The process proceeds in the same way. More specifically, three adjacent ejection grooves 5*a* are selected in order repeatedly and liquid is caused to be ejected. This enables higher density recording compared with the case of the liquid jet head 1 according to the first embodiment.

As described above, the reinforcing plate 17 formed of a ceramic material is placed between the nozzle plate 4 and the side walls 6, and thus, the conversion efficiency in converting deformation of the side walls 6 into pressure fluctuations of liquid in the ejection grooves 5*a* may be improved.

Fourth Embodiment

Figure 6:
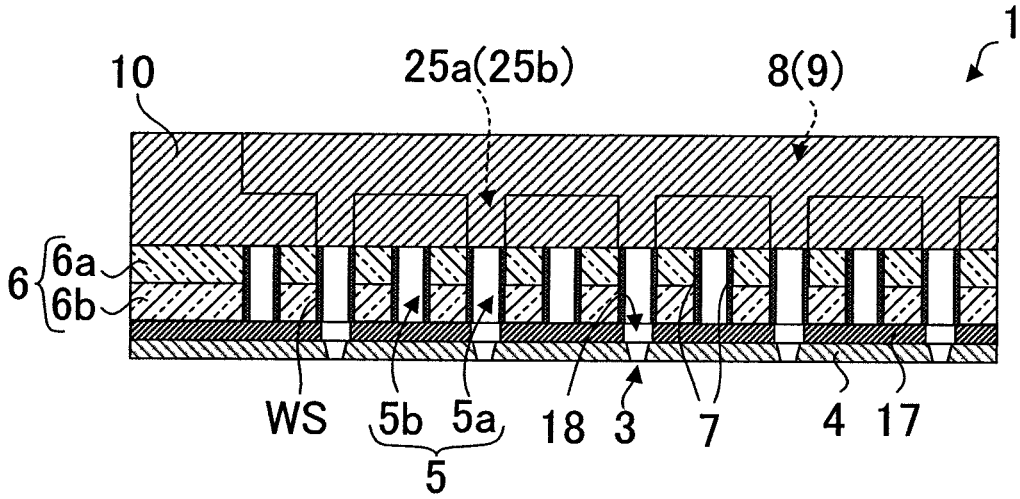
FIG. 6 is a schematic vertical sectional view of a liquid jet head according to a fourth embodiment of the present invention.

FIG. 6 illustrates a liquid jet head 1 according to a fourth embodiment of the present invention, and is a schematic vertical sectional view taken in a direction orthogonal to the longitudinal direction of the grooves 5. This embodiment is different from the second embodiment in the structure of the side walls 6 and in the drive electrodes 7 formed on the wall surfaces WS thereof, and is similar to the second embodiment in other respects. Therefore, in the following, points different from the second embodiment are mainly described and description of the same points is omitted. Like reference symbols are used to represent like members or members having like functions.

The liquid jet head 1 has a laminated structure of the nozzle plate 4, the reinforcing plate 17, the side walls 6, and the cover plate 10. The plurality of side walls 6 form the plurality of grooves 5 having a fixed depth, and the plurality of grooves 5 include the ejection grooves 5*a* and the dummy grooves 5*b* which are alternately arranged in parallel to one another. The cover plate 10 includes the supply port 8 and the discharge port 9 (not shown), and the supply port 8 and the discharge port 9 communicate with the ejection grooves 5*a* via the slits 25*a* and the slits 25*b* (not shown). The reinforcing plate 17 includes the through holes 18 at locations corresponding to the ejection grooves 5*a*, and the through holes 18 communicate with the ejection grooves 5*a*, respectively. The nozzle plate 4 includes the nozzles 3 at locations corresponding to the through holes 18, and the nozzles 3 communicate with the through holes 18, respectively.

Here, the side walls 6 are formed of a piezoelectric body which is polarized, and the direction of the polarization of side walls 6*a* which are located at upper halves of the side walls 6 and the direction of the polarization of side wall 6*b* which are located at lower halves of the side walls 6 are opposite to each other. For example, the side walls 6*a* are upwardly polarized while the side walls 6*b* are downwardly polarized. The drive electrodes 7 are formed from the upper ends to the lower ends of the wall surfaces WS of the side walls 6*a* and of the side walls 6*b*. When both drive electrodes 7 of the ejection groove 5*a* are connected to the GND and a drive signal is applied to two drive electrodes 7 on the ejection groove 5*a* side of two dummy grooves 5*b* adjacent to the ejection groove 5*a*, the side walls 6 are bent with respect to the vertical direction and a pressure wave is produced in liquid filled into the ejection groove 5*a* to eject liquid from the corresponding nozzle 3. When the directions of the polarization are set opposite to each other and the same voltage is applied to the side walls 6*a* and the side walls 6*b*, compared with a case in which voltage is applied only to the side walls 6*a* which are located at the upper halves, the amount of deformation of the side walls 6 becomes larger, and thus, when the same amount of deformation is caused, the drive voltage in this embodiment may be set lower than that in the second embodiment.

Note that, the cover plate 10 may be placed on the upper surfaces of the side walls 6 so that the upper surface ends in the longitudinal direction of the side walls 6 are exposed, and, similarly to the second embodiment, the extracting electrodes 16 may be formed on the upper surface ends, and the flexible substrate 20 having the wiring electrodes 21 formed thereon may be bonded to the extracting electrodes 16. Further, similarly to the third embodiment, all the grooves 5 may be the ejection grooves 5*a* and liquid droplets may be ejected in accordance with the three-cycle drive system to enable high density recording.

As described above, the reinforcing plate 17 formed of a ceramic material is inserted between the side walls 6 and the nozzle plate 4, and thus, the conversion efficiency in converting deformation of the side walls 6 into pressure fluctuations of liquid in the ejection grooves 5*a* is improved. Further, if the used ceramic material is insulating, even when a lower end of one drive electrode 7 is brought into contact with the reinforcing plate 17, the one drive electrode 7 does not cause a short circuit with another drive electrode 7, and it is not necessary to form an insulating film on the surface of the reinforcing member 94 on the pressure chamber 74 side as in the conventional case illustrated in FIG. 14.

Fifth Embodiment

Figure 7A:
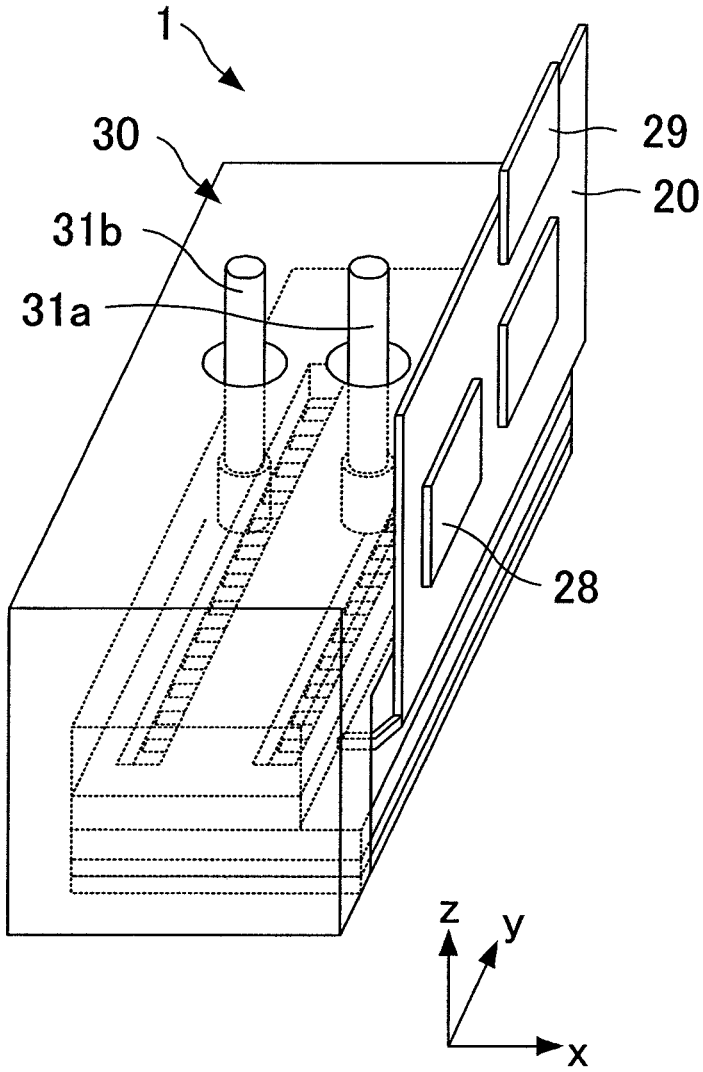
FIGS. 7A and 7B are schematic perspective views of a liquid jet head according to a fifth embodiment of the present invention.
Figure 7B:
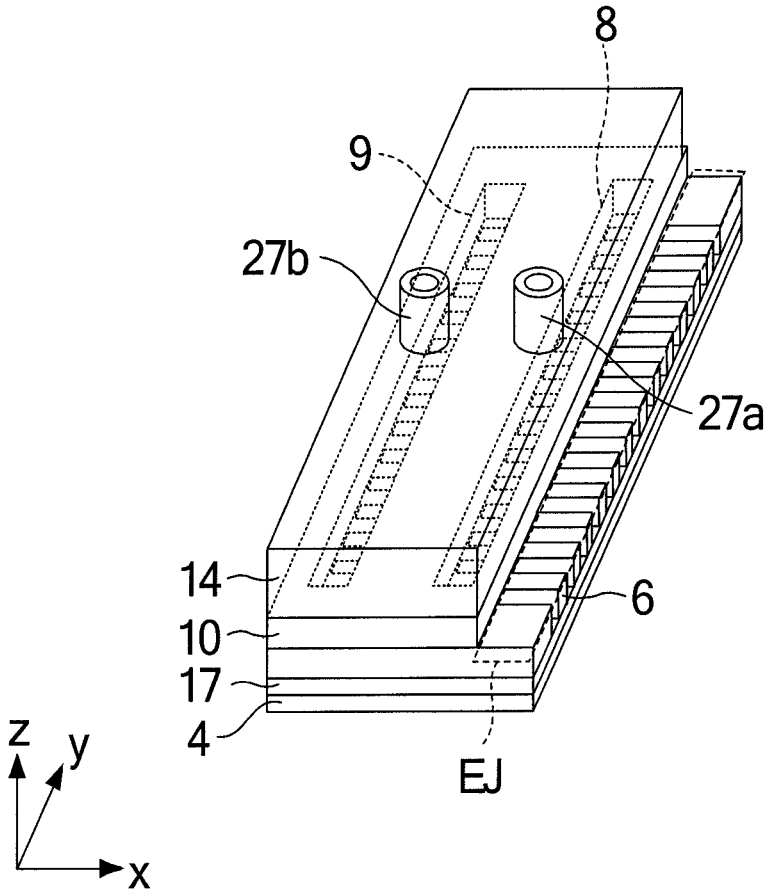

FIGS. 7A and 7B are schematic perspective views of a liquid jet head 1 according to a fifth embodiment of the present invention. FIG. 7A is a perspective view of the entire liquid jet head 1 and FIG. 7B is a perspective view illustrating the inside of the liquid jet head 1.

As illustrated in FIGS. 7A and 7B, the liquid jet head 1 has a laminated structure of the nozzle plate 4, the reinforcing plate 17, the plurality of side walls 6, the cover plate 10, and a flow path member 14. The laminated structure of the nozzle plate 4, the reinforcing plate 17, the plurality of side walls 6, and the cover plate 10 is the same as that of any one of the first to fourth embodiments. The width of the nozzle plate 4, the reinforcing plate 17, and the side walls 6 in the y direction is longer than the width of the cover plate 10 and the flow path member 14 in the y direction, and the cover plate 10 is bonded to the upper surfaces of the side walls 6 so that the upper surface ends EJ on one side of the side walls 6 are exposed. The plurality of side walls 6 are arranged in an x direction in parallel to one another, and the plurality of grooves 5 having a fixed depth are formed between adjacent side walls 6, respectively. The cover plate 10 includes the supply port 8 and the discharge port 9 which communicate with the plurality of grooves 5.

The flow path member 14 includes a liquid supply chamber (not shown) and a liquid discharge chamber (not shown) which are concave portions that open to a surface of the flow path member 14 on the cover plate 10 side, and includes, in a surface thereof on the side opposite to the cover plate 10, a supply joint 27*a* which communicates with the liquid supply chamber and a discharge joint 27*b* which communicates with the liquid discharge chamber.

The drive electrodes (not shown) are formed on the wall surfaces of the side walls 6, respectively, and are electrically connected to the extracting electrodes (not shown) which are formed on the upper surface ends EJ of corresponding side walls 6. The flexible substrate 20 is bonded to the upper surface ends EJ. A large number of wiring electrodes are formed on a surface of the flexible substrate 20 on the upper surface end EJ side, and are electrically connected to the extracting electrodes formed on the upper surface ends EJ. The flexible substrate 20 includes, on a surface thereof, a driver IC 28 as a drive circuit and a connector 29. Based on a signal which is input from the connector 29, the driver IC 28 generates a drive signal for driving the side walls 6, and supplies the drive signal via the wiring electrodes and the extracting electrodes to the drive electrodes (not shown).

A base 30 houses a laminated body of the nozzle plate 4, the side walls 6, the cover plate 10, and the flow path member 14. A liquid jetting surface of the nozzle plate 4 is exposed on a lower surface of the base 30. The flexible substrate 20 is drawn to the outside from a side surface of the base 30, and is fixed to an outer side surface of the base 30. An upper surface of the base 30 includes two through holes. A supply tube 31*a* for supplying liquid passes through one of the through holes to be connected to the supply joint 27*a* while a discharge tube 31*b* for discharging liquid passes through the other of the through holes to be connected to the discharge joint 27*b*. Other points in the structure are similar to those of any one of the first to fourth embodiments, and thus, the description thereof is omitted.

The flow path member 14 is provided so that liquid is supplied from above and liquid is discharged to the above, and further, the driver IC 28 is mounted on the flexible substrate 20 and the flexible substrate 20 is bent in a z direction so as to be provided upright. If any one of the second to fourth embodiments is employed, when the grooves 5 are formed, the outside shape of the dicing blade is prevented from being reflected on ends in the y direction of the grooves 5 to cause dead spaces, and thus, the width in the y direction may be set small, and in addition, the wiring may become compact. Further, the driver IC 28 and the side walls 6 generate heat when driven, and such heat is transferred via the base 30 and the flow path member 14 to liquid which passes therethrough. More specifically, liquid for recording on a recording medium may be utilized as a cooling medium to effectively dissipate to the outside heat generated inside. Therefore, degradation in drive performance due to overheat of the driver IC 28 or the side walls 6 may be prevented. Further, liquid circulates within the ejection grooves, and thus, even if air bubbles enter the ejection groove, such air bubbles may be promptly discharged to the outside. Further, liquid is not wasted, and waste of a recording medium due to recording failure may be suppressed. This enables provision of the reliable liquid jet head 1.

(Liquid Jet Apparatus)

Sixth Embodiment

Figure 8:
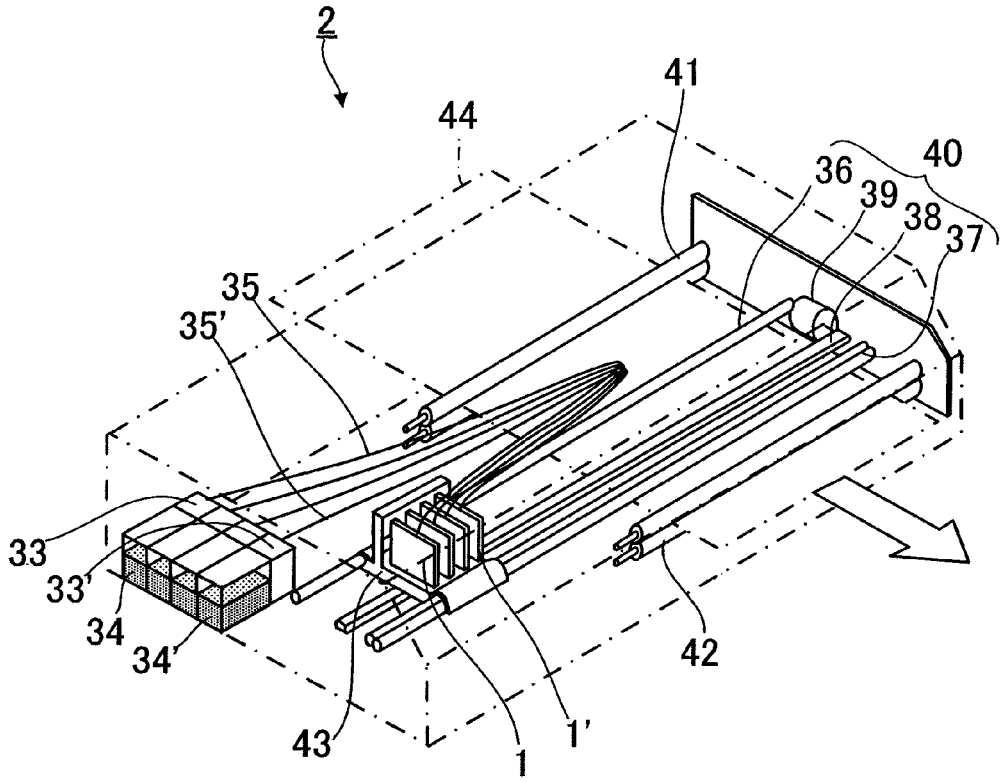
FIG. 8 is a schematic perspective view of a liquid jet apparatus according to a sixth embodiment of the present invention.

FIG. 8 is a schematic perspective view of a liquid jet apparatus 2 according to a sixth embodiment of the present invention. The liquid jet apparatus 2 includes a moving mechanism 40 for reciprocating liquid jet heads 1 and 1', flow path portions 35 and 35' for supplying liquid to the liquid jet heads 1 and 1', and liquid pumps 33 and 33' and liquid tanks 34 and 34' for supplying liquid to the flow path portions 35 and 35'. Each of the liquid jet heads 1 and 1' includes a plurality of ejection grooves, and a liquid droplet is ejected through a nozzle which communicates with each of the ejection grooves. As the liquid jet heads 1 and 1', any ones of the liquid jet heads of the first to fifth embodiments described above are used.

The liquid jet apparatus 2 includes a pair of conveyance means 41 and 42 for conveying a recording medium 44 such as paper in a main scanning direction, the liquid jet heads 1 and 1' for ejecting liquid toward the recording medium 44, a carriage unit 43 for mounting thereon the liquid jet heads 1 and 1', the liquid pumps 33 and 33' for pressurizing liquid stored in the liquid tanks 34 and 34' into the flow path portions 35 and 35' for supply, and the moving mechanism 40 for causing the liquid jet heads 1 and 1' to scan in a sub-scanning direction which is orthogonal to the main scanning direction. A control portion (not shown) controls and drives the liquid jet heads 1 and 1', the moving mechanism 40, and the conveyance means 41 and 42.

Each of the pair of conveyance means 41 and 42 includes a grid roller and a pinch roller which extend in the sub-scanning direction and which rotate with roller surfaces thereof being in contact with each other. A motor (not shown) axially rotates the grid rollers and the pinch rollers to convey in the main scanning direction the recording medium 44 sandwiched therebetween. The moving mechanism 40 includes a pair of guide rails 36 and 37 which extend in the sub-scanning direction, the carriage unit 43 which is slidable along the pair of guide rails 36 and 37, an endless belt 38 which is coupled to the carriage unit 43 for moving the carriage unit 43 in the sub-scanning direction, and a motor 39 for rotating the endless belt 38 via a pulley (not shown).

The carriage unit 43 has the plurality of liquid jet heads 1 and 1' mounted thereon for ejecting, for example, four kinds of liquid droplets: yellow; magenta; cyan; and black. The liquid tanks 34 and 34' store liquid of corresponding colors, and supply the liquid via the liquid pumps 33 and 33' and the flow path portions 35 and 35' to the liquid jet heads 1 and 1'. The respective liquid jet heads 1 and 1' eject liquid droplets of the respective colors in accordance with a drive signal. Through control of ejection timings of liquid from the liquid jet heads 1 and 1', rotation of the motor 39 for driving the carriage unit 43, and conveyance speed of the recording medium 44, an arbitrary pattern may be recorded on the recording medium 44.

(Method of Manufacturing Liquid Jet Head)

Figure 9:
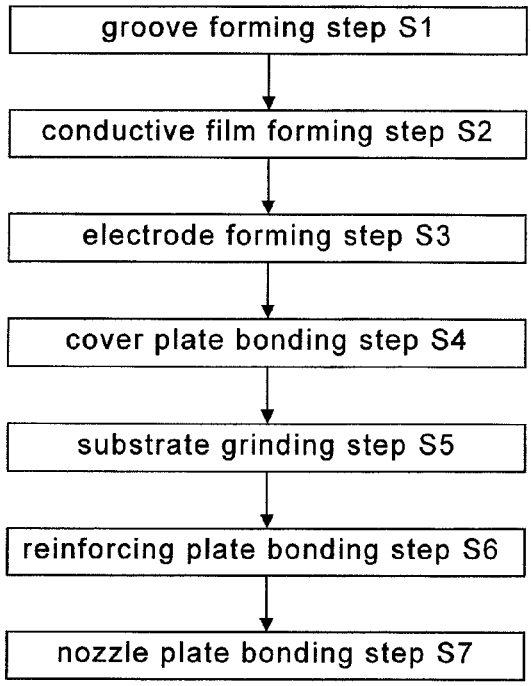
FIG. 9 is a process flow chart illustrating a basic method of manufacturing the liquid jet head according to the present invention.

Next, a method of manufacturing a liquid jet head according to the present invention is described. FIG. 9 is a process flow chart illustrating a basic method of manufacturing the liquid jet head according to the present invention. First, a piezoelectric substrate, a substrate formed by laminating a piezoelectric substrate and an insulating substrate, or a substrate formed by bonding two piezoelectric substrates in which the directions of polarization are opposite to each other is prepared, and a plurality of grooves are formed in a front surface thereof (groove forming step S1). As the piezoelectric substrate, PZT ceramic may be used. Then, a conductor is deposited on the front surface of the substrate having the grooves formed therein (conductive film forming step S2). A metal material is used as the conductor, and vapor deposition, sputtering, plating, or the like is used to deposit and form the conductive film. After that, the conductive film is patterned to form electrodes (electrode forming step S3). With regard to the electrodes, drive electrodes are formed on wall surfaces of side walls while extracting electrodes are formed on upper surfaces of the side walls. With regard to the patterning, photolithography and etching, lift-off, or laser application is used to locally remove the conductive film and to form an electrode pattern.

Then, a cover plate is bonded to the front surface of the substrate, that is, the upper surfaces of the plurality of side walls (cover plate bonding step S4). In the bonding, an adhesive may be used. A supply port and a discharge port which pass through the cover plate from a front surface to a rear surface of the cover plate and communicate with the plurality of grooves are formed in advance. As the cover plate, the same material as that of the substrate to which the cover plate is bonded, for example, PZT ceramic, may be used. When the thermal expansion coefficient of the substrate and the thermal expansion coefficient of the cover plate are set equal to each other, peeling and a crack may be less liable to occur to improve the durability. Next, the rear surface which is opposite to the front surface of the substrate is ground to cause the plurality of grooves to open to the rear surface side (substrate grinding step S5). When the grooves are caused to open, the side walls which separate the grooves are separated, but the cover plate is bonded to the upper surface side, and thus, the side walls do not fall down to pieces. Then, a reinforcing plate formed of a ceramic material is bonded to lower surfaces of the plurality of side walls (reinforcing plate bonding step S6). The reinforcing plate having through holes formed in advance therein at locations corresponding to the grooves is bonded to the lower surfaces of the side walls, and after that, the reinforcing plate may be ground to be a thin plate. Next, a nozzle plate is bonded to an outer surface of the reinforcing plate (nozzle plate bonding step S7).

According to the manufacturing method of the present invention, a ceramic material is used as the reinforcing plate, and thus, bonding may be carried out with high positional accuracy. If the used ceramic material is insulating, a drive signal does not leak. Further, a ceramic material is highly resistant to corrosion, and thus, even when corrosive ink is used, the durability is not reduced. In the following, the present invention is described in detail based on an embodiment thereof.

Seventh Embodiment

Figure 10:
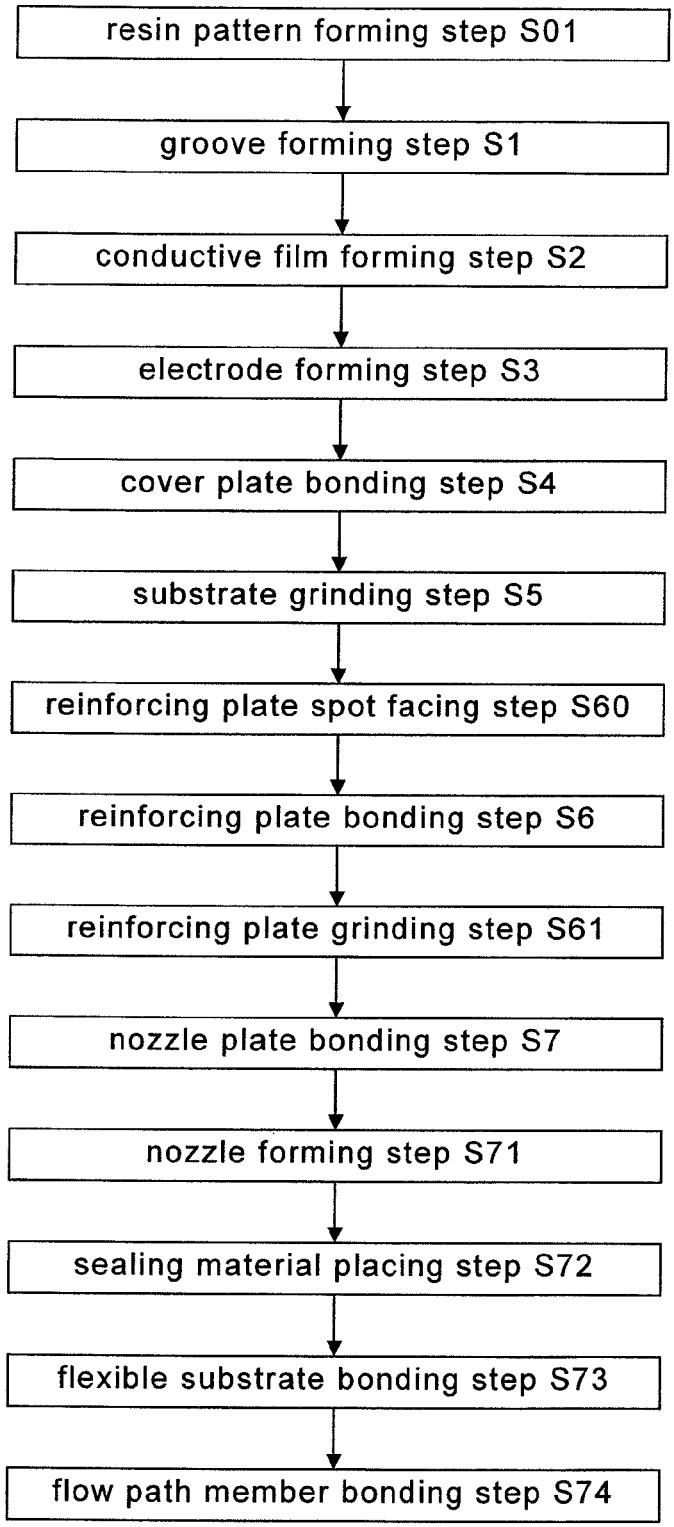
FIG. 10 is a process flow chart illustrating a method of manufacturing a liquid jet head according to a seventh embodiment of the present invention.

FIGS. 10 to 13C illustrate a method of manufacturing a liquid jet head according to a seventh embodiment of the present invention. FIG. 10 is a process flow chart illustrating the method of manufacturing a liquid jet head, and FIGS. 11A to 13C are explanatory diagrams of the respective steps. In this embodiment, there are added, to the basic steps of the groove forming step S1 to the nozzle plate bonding step S7 illustrated in FIG. 9, a resin pattern forming step S01 for forming electrodes by lift-off, a reinforcing plate spot facing step S60 of spot facing the reinforcing plate, a reinforcing plate grinding step S61 of grinding the reinforcing plate bonded to the lower surfaces of the side walls, a nozzle forming step S71 of forming nozzles in the nozzle plate, a sealing material placing step S72 of closing the ejection grooves with sealing materials, a flexible substrate bonding step S73 of bonding the flexible substrate to the upper surface ends EJ, and a flow path member bonding step S74 of bonding the flow path member to the upper surface of the cover plate. Like reference symbols are used to represent like members or members having like functions.

Figure 11A:
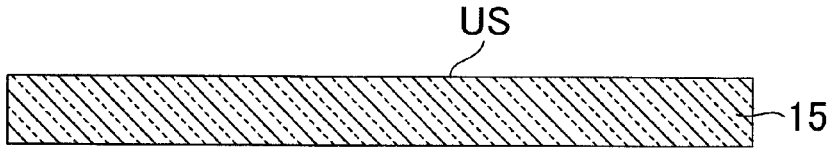
FIGS. 11A to 11G are views illustrating the method of manufacturing a liquid jet head according to the seventh embodiment of the present invention.
Figure 11B:
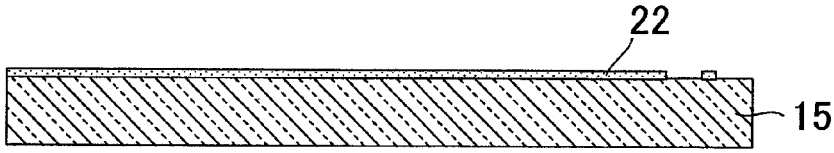

FIG. 11A is a vertical sectional view of a piezoelectric substrate 15. As the piezoelectric substrate 15, PZT ceramic is used, and polarization is carried out in a vertical direction of the substrate. FIG. 11B is an explanatory diagram of the resin pattern forming step S01 in which a photosensitive resin 22 such as a resist is applied or affixed to the upper surfaces US of the piezoelectric substrate 15 and is patterned. The photosensitive resin 22 is removed from a region in which the conductor for forming the electrodes is left, and the photosensitive resin 22 is left in a region in which the conductor is not left.

Figure 11C:
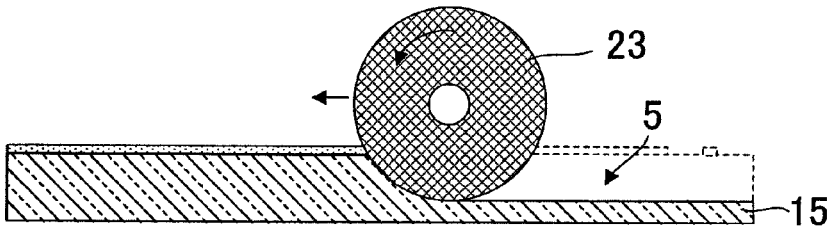
Figure 11D:
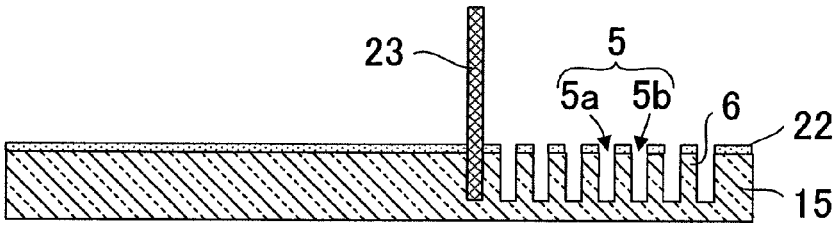

FIGS. 11C and 11D are explanatory diagrams of the groove forming step S1 in which the plurality of grooves 5 are formed in the front surface of the piezoelectric substrate 15 by a dicing blade 23. FIG. 11C is a view seen from a side of the dicing blade 23, while FIG. 11D is a view seen from a direction of movement of the dicing blade 23. The ejection grooves 5*a* and the dummy grooves 5*b* which are alternately arranged so as to be in parallel with one another are formed by grinding with the side wall 6 interposed between the ejection groove 5*a* and the dummy groove 5*b*. The grooves 5 have a fixed depth, for example, a depth of 300 μm to 350 μm, and the width of the ejection grooves 5*a* and the dummy grooves 5*b* is 30 μm to 100 μm.

Figure 11E:
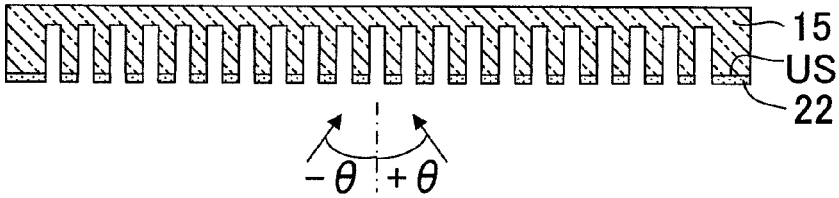
Figure 11F:
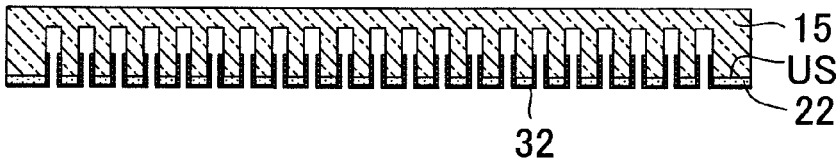

FIGS. 11E and 11F are explanatory diagrams of the conductive film forming step S2 in which a conductor is deposited by oblique deposition on a surface of the piezoelectric substrate 15 to which the grooves 5 are open to form a conductive film 32, and the piezoelectric substrate 15 illustrated in FIG. 11D is turned upside down. Under a state in which the upper surfaces US of the piezoelectric substrate 15 are oriented downwardly, the conductor is deposited from directions of an inclination angle (−θ) and an inclination angle (+θ) with respect to the normal to the upper surfaces US of the piezoelectric substrate 15 which are orthogonal to the longitudinal direction of the grooves 5. In this way, the conductor is deposited on the upper halves of the wall surfaces on the upper surface US side and the upper surfaces US of the side walls 6 to form the conductive film 32. As the conductor, a metal such as Al, Mo, Cr, Ag, or Ni may be used. By oblique deposition, the desired conductive film 32 may be formed in the depth direction of the grooves 5, and thus, it is not necessary to pattern the conductive film 32 which is deposited on the wall surfaces WS of the side walls 6.

Figure 11G:
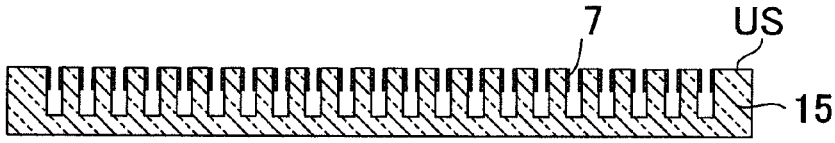

FIG. 11G is an explanatory diagram of the electrode forming step S3 in which the conductive film 32 is patterned by lift-off to form the electrodes, and the piezoelectric substrate 15 illustrated in FIG. 11F is turned upside down. The photosensitive resin 22 and the conductive film 32 on the photosensitive resin 22 are removed from the upper surfaces US of the piezoelectric substrate 15, and the drive electrodes 7 are formed on the wall surfaces of the grooves 5 while the extracting electrodes (not shown) are formed on the upper surfaces US of the side walls 6. Note that, the conductive film 32 may be patterned after the conductive film forming step S2 by photolithography and etching or by a laser, but the above-mentioned lift-off may contribute to easier patterning.

Figure 12A:
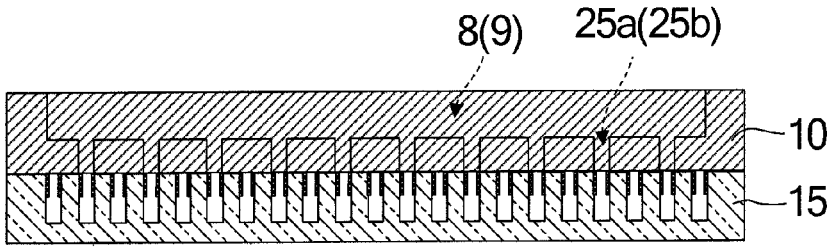
FIGS. 12A to 12F are views illustrating the method of manufacturing a liquid jet head according to the seventh embodiment of the present invention.

FIG. 12A is an explanatory diagram of the cover plate bonding step S4 in which the cover plate 10 is bonded to the front surface of the piezoelectric substrate 15 (upper surfaces US). The supply port 8, the discharge port 9, and the slits 25 are formed in advance in the cover plate 10. The cover plate 10 is bonded using an adhesive to the front surface of the piezoelectric substrate 15 (upper surfaces US) so that the upper surface ends of the piezoelectric substrate 15 are exposed. In the bonding, the slits 25 are caused to communicate with the ejection grooves 5*a* and the supply port 8 and the discharge port 9 are caused to be closed to the dummy grooves 5*b*. It is preferred that, as the cover plate 10, a material having a thermal expansion coefficient substantially equal to that of the piezoelectric substrate 15 be used. In this embodiment, PZT ceramic is used as the cover plate 10.

Figure 12B:
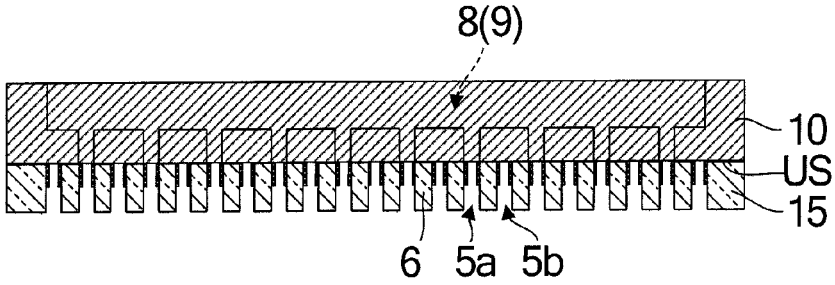

FIG. 12B is an explanatory diagram of the substrate grinding step S5 in which the rear surface which is opposite to the front surface of the piezoelectric substrate 15 is ground to cause the grooves 5 to open to the rear surface side. A grinder or a polishing plate is used to grind the piezoelectric substrate 15 from the rear surface side to cause the ejection grooves 5*a* and the dummy grooves 5*b* to open to the rear surface side. This separates the side walls 6 from one another, but the upper surfaces US of the side walls 6 are adhered to the cover plate 10, and thus, the side walls 6 do not fall down to pieces.

Figure 12C:
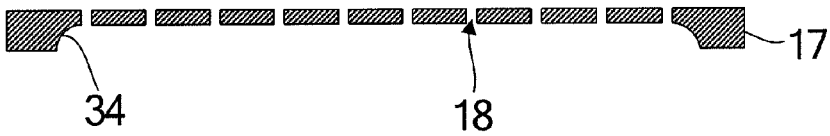

FIG. 12C illustrates a state in which, after the reinforcing plate spot facing step S60 of forming a spot facing portion 34 on a surface of the reinforcing plate 17 formed of a ceramic material, the through holes 18 are formed in the spot facing portion 34. It is extremely difficult to form in a ceramic plate a large number of narrow holes having a diameter of several tens of micrometers to 100 μm and a depth of 200 μm or more so as to be aligned with the ejection grooves 5*a*, respectively. Accordingly, a ceramic plate (reinforcing plate 17) having a thickness of, for example, 0.2 mm to 1 mm is prepared, and the spot facing portion 34 is formed by sandblasting at locations corresponding to the plurality of ejection grooves 5*a* under a state in which the bottom portion having a thickness of about 0.1 mm to 0.2 mm is left. Then, the through holes 18 are formed by sandblasting or the like in the bottom portion of the spot facing portion 34, and the reinforcing plate 17 is bonded to a rear surface side of the piezoelectric substrate 15 under a state in which the spot facing portion 34 is oriented outside (on a side opposite to the side walls 6).

Figure 12D:
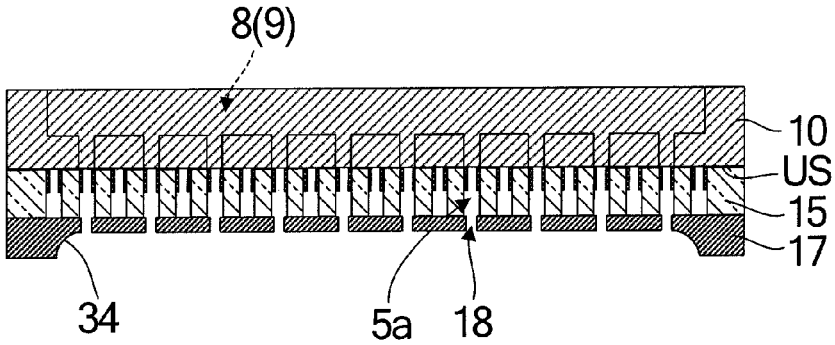

FIG. 12D is an explanatory diagram of the reinforcing plate bonding step S6 in which the reinforcing plate 17 is bonded to the rear surface side of the piezoelectric substrate 15. The reinforcing plate 17 is bonded using an adhesive to the rear surface side of the piezoelectric substrate 15, that is, of the side walls 6. The reinforcing plate 17 is provided with the through holes 18 which are substantially in the middle between the supply port 8 and the discharge port 9 in the cover plate 10 and which communicate with the ejection grooves 5*a*, and the spot facing portion 34 which communicates with the through holes 18 is provided below the through holes 18. When the through holes 18 are formed in the reinforcing plate 17 before the reinforcing plate 17 is bonded using an adhesive to the lower surfaces of the side walls 6 and the piezoelectric substrate 15, the adhesive may escape through the through holes 18 in the bonding. This may eliminate excessive adhesive to bond the reinforcing plate 17 in a flat state to the lower surfaces of the side walls 6.

Figure 12E:
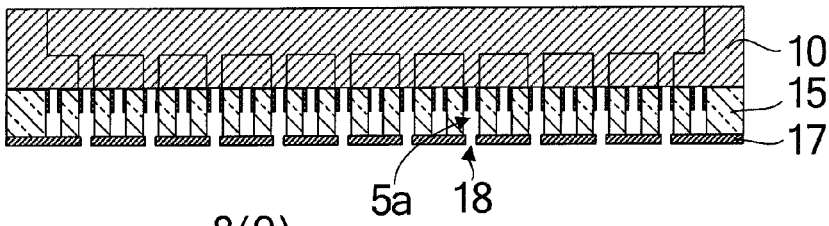

FIG. 12E is an explanatory diagram of the reinforcing plate grinding step S61 in which the lower surface of the reinforcing plate 17 is ground to cause the reinforcing plate 17 to be a thin plate. A grinder or a polishing plate is used to cause the reinforcing plate 17 to be a thin plate and the spot facing portion 34 is removed. The thickness of the reinforcing plate 17 is set to 50 μm to 100 μm. If the thickness is more than 100 μm, air bubbles are more liable to attach to the side walls of the through holes 18 and the like, and, if the thickness is too small, the handling becomes difficult.

Figure 12F:
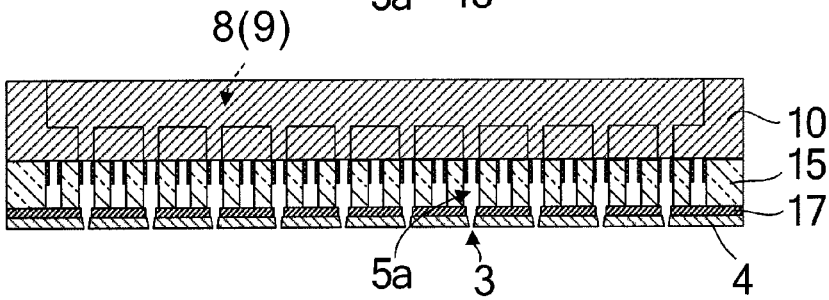

FIG. 12F is an explanatory diagram of the nozzle plate bonding step S7 in which the nozzle plate 4 is bonded to the reinforcing plate 17 on the side opposite to the side walls 6. As the nozzle plate 4, a polyimide film is used. The nozzle plate 4 is provided with the nozzles 3 at locations corresponding to the through holes 18 in the reinforcing plate 17 (nozzle forming step S71). The nozzles 3 may be formed before the nozzle plate 4 is bonded to the reinforcing plate 17, or after the nozzle plate 4 is bonded to the reinforcing plate 17. Formation of the nozzles 3 after the nozzle plate 4 is bonded to the reinforcing plate 17 facilitates alignment. The nozzles 3 are formed by applying a laser from the outside.

Figure 13A:
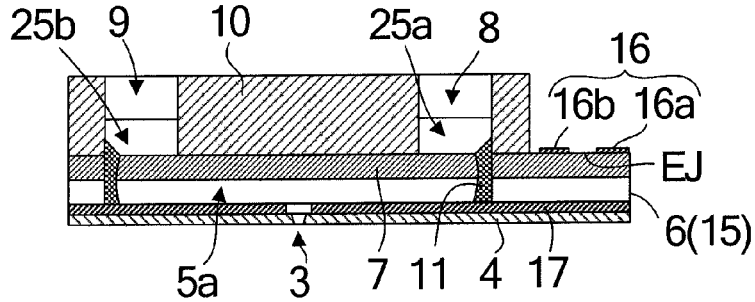
FIGS. 13A to 13C are views illustrating the method of manufacturing a liquid jet head according to the seventh embodiment of the present invention.

FIG. 13A is an explanatory diagram of the sealing material placing step S72 in which the sealing materials 11 are placed for closing the ejection grooves 5*a* outside the communicating portions with the supply port 8 and the discharge port 9. The sealing materials 11 close the ejection grooves 5*a* to prevent liquid from leaking to the outside. In FIG. 13A, the sealing materials 11 are provided on the supply port 8 side and on the discharge port 9 side, respectively, but the sealing materials 11 may be provided on the end side of the cover plate 10. Note that, as illustrated in FIG. 13A, the extracting electrodes 16 are formed on the upper surface ends EJ of the side walls 6 (piezoelectric substrate 15). The individual extracting electrodes 16*a* are placed on the end side of the side walls 6 (piezoelectric substrate 15), while the common extracting electrodes 16*b* are placed on the end side of the cover plate 10.

Figure 13B:
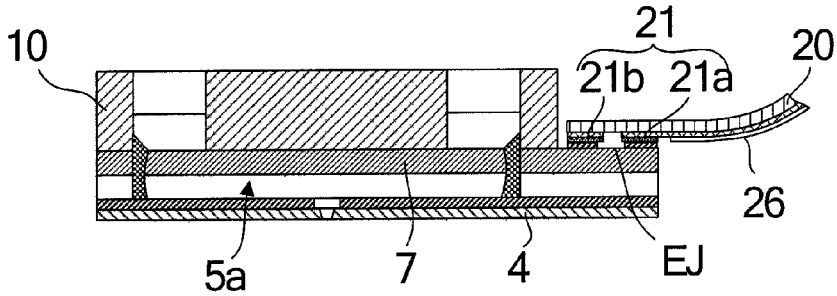

FIG. 13B is an explanatory diagram of the flexible substrate bonding step S73 in which the flexible substrate 20 is bonded to the upper surface ends EJ. The wiring electrodes 21 including the individual wiring electrodes 21*a* and the common wiring electrode 21*b* are formed in advance in the flexible substrate 20. The flexible substrate 20 is bonded to the upper surface ends EJ of the piezoelectric substrate 15 so that the individual wiring electrodes 21*a* and the corresponding individual extracting electrodes 16*a* are electrically connected and the common wiring electrode 21*b* and the common extracting electrodes 16*b* are electrically connected. The wiring electrodes 21 and the extracting electrodes 16 are bonded to each other, for example, via an anisotropic conductor. The wiring electrodes 21 on the flexible substrate 20 are covered with and protected by the protective film 26 in a region other than the bonded region. Further, the flexible substrate 20 is bonded to the upper surface ends EJ on the side opposite to the nozzle plate 4 at which liquid is ejected, and thus, the thickness of the bonded portion is not limited and the design flexibility increases.

Figure 13C:
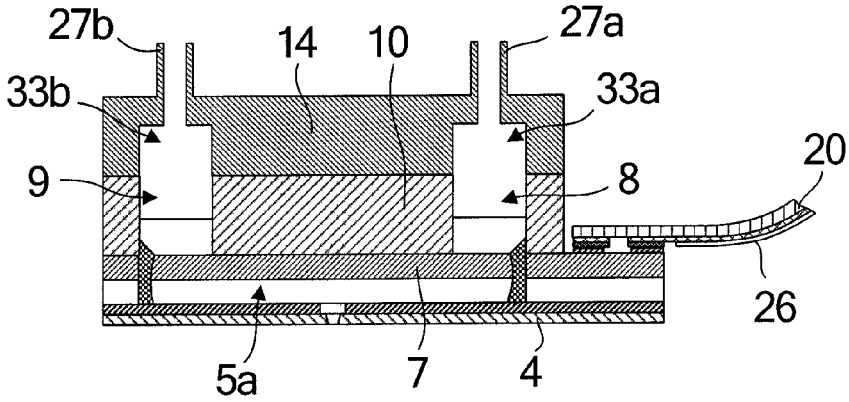

FIG. 13C is an explanatory diagram of the flow path member bonding step S74 in which the flow path member 14 is bonded to the upper surface of the cover plate 10. A supply flow path 33*a*, the supply joint 27*a* which communicates with the supply flow path 33*a*, a discharge flow path 33*b*, and the discharge joint 27*b* which communicates with the discharge flow path 33*b* are formed in advance in the flow path member 14. In the bonding, the supply flow path 33*a* in the flow path member 14 is aligned with the supply port 8 in the cover plate 10 and the discharge flow path 33*b* in the flow path member 14 is aligned with the discharge port 9 in the cover plate 10. The supply joint 27*a* and the discharge joint 27*b* in the flow path member 14 are placed in the upper surface of the flow path member 14, and thus, piping may be concentrated and the structure may be downsized.

Note that, the method of manufacturing the liquid jet head 1 according to the present invention is not limited to forming the ejection grooves 5*a* and the dummy grooves 5*b* alternately so as to be in parallel with one another, but all the grooves 5 may be the ejection grooves 5*a*, and the nozzles 3 and the through holes 18 may be formed correspondingly to the ejection grooves 5*a*, respectively. Further, as the side walls 6, laminated piezoelectric bodies in which the directions of polarization are opposite to each other may be used, and the drive electrodes 7 may be formed on the entire wall surfaces WS of the side walls 6 from the upper ends to the lower ends of the wall surfaces WS. Further, it is not required to carry out the steps in the above-mentioned order, and, for example, the nozzle plate 4 and the reinforcing plate 17 may be adhered together in advance to form a laminated structure, and then the laminated body may be bonded to the lower surfaces of the side walls 6 and the piezoelectric substrate 15. Further, instead of forming the grooves 5 as straight grooves having a fixed depth, the grooves 5 may be grooves in the shape of a boat as in the first embodiment. In that case, the sealing material placing step S72 is unnecessary.

Eighth Embodiment

Figure 15:
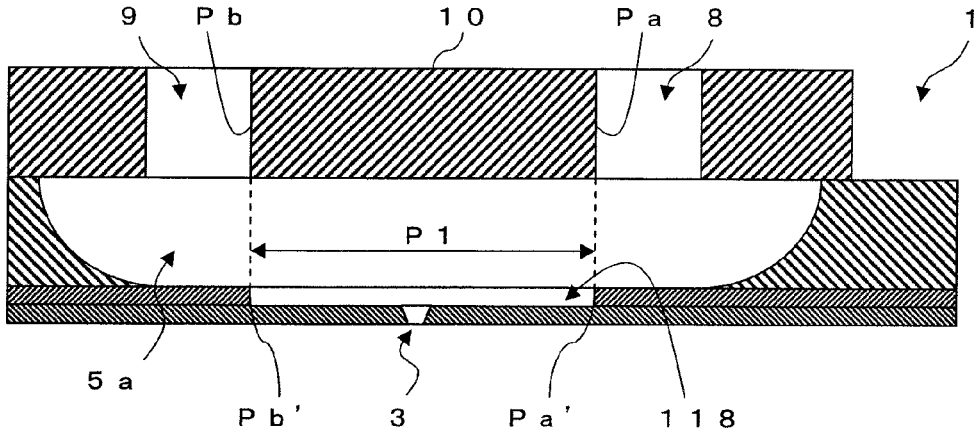
FIG. 15 is a schematic vertical sectional view of a liquid jet head according to an eighth embodiment of the present invention.

FIG. 15 is schematic vertical sectional views of a liquid jet head 1 according to an eighth embodiment of the present invention, and is a sectional view in a direction along the ejection groove 5*a*. This embodiment is different from the first embodiment in width P1 of through holes 118. The width P1 is equivalent to width between a side surface Pa of the supply port 8 and a side surface Pb of the discharge port 9. In other respects, the liquid jet head of this embodiment is similar to the first embodiment. Therefore, in the following description, points different from the first embodiment are mainly described and description of the same points is omitted. Like reference symbols are used to represent like members or members having like functions.

Side surface Pa' of through holes 118 corresponds to the side surface Pa. The side surface Pa' is located just below the side surface Pa. Side surface Pb' of through holes 118 corresponds to the side surface Pb. The side surface Pb' is located just below the side surface Pb. The width P1 is equivalent to width between the side surface Pa and the side surface Pb.

When ink flows to the discharge port 9 from the supply port 8 through the ejection groove 5*a* for this embodiment, ink flow can remove the air bubble stuck in through holes 118 and an air bubble can be discharged from the ejection groove 5*a* effectively. Because the width P1 is expanded more than the first embodiment, the ink flow influences an air bubble effectively. In addition, it is described to adopt the through holes described in the first embodiment, but it's possible to adopt the through holes described in the second embodiment.

Ninth Embodiment

Figure 16:
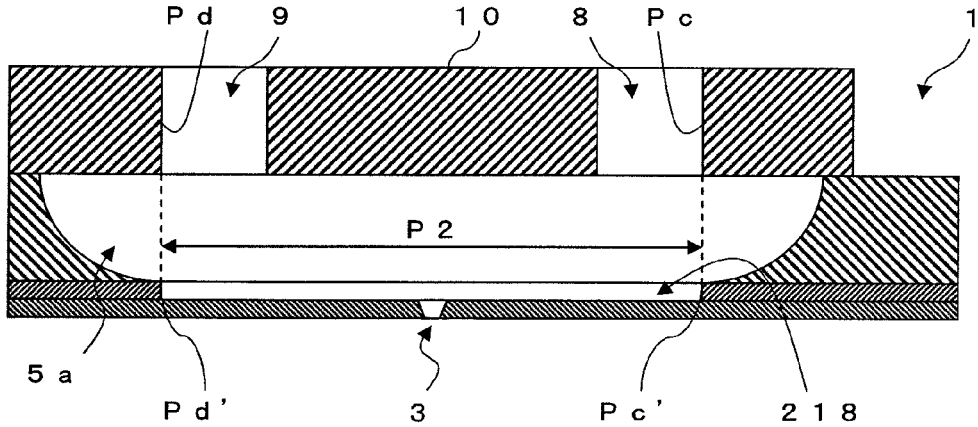
FIG. 16 is a schematic vertical sectional view of a liquid jet head according to a ninth embodiment of the present invention.

FIG. 16 is schematic vertical sectional views of a liquid jet head 1 according to a ninth embodiment of the present invention, and is a sectional view in a direction along the ejection groove 5*a*. This embodiment is different from the first embodiment in width P2 of through holes 218. The width P2 is equivalent to width between a side surface Pc of the supply port 8 and a side surface Pd of the discharge port 9. Moreover, the width P2 is wider than the width P1. In other respects, the liquid jet head of this embodiment is similar to the first embodiment. Therefore, in the following description, points different from the first embodiment are mainly described and description of the same points is omitted. Like reference symbols are used to represent like members or members having like functions.

Side surface Pc' of through holes 218 corresponds to the side surface Pc. The side surface Pc' is located just below the side surface Pc. Side surface Pd' of through holes 218 corresponds to the side surface Pd. The side surface Pd' is located just below the side surface Pd. The width P2 is equivalent to width between the side surface Pc and the side surface Pd.

When ink flows to the discharge port 9 from the supply port 8 through the ejection groove 5*a* for this embodiment, ink flow can remove the air bubble stuck in through holes 218 and an air bubble can be discharged from the ejection groove 5*a* effectively. Because the width P2 is expanded more than the first embodiment, the ink flow influences an air bubble effectively. Moreover, it's possible to discharge the air bubble from through holes 218 more effectively because through holes 218 is formed just below the supply port 8 and the discharge port 9. In addition, it is described to adopt the through holes described in the first embodiment, but it's possible to adopt the through holes described in the second embodiment.

Tenth Embodiment

Figure 17:
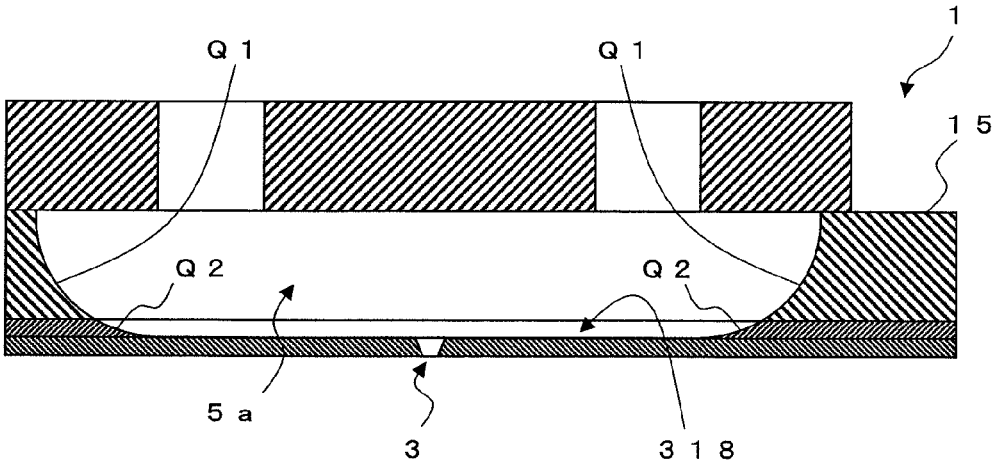
FIG. 17 is a schematic vertical sectional view of a liquid jet head according to a tenth embodiment of the present invention.

FIG. 17 is schematic vertical sectional views of a liquid jet head 1 according to a tenth embodiment of the present invention, and is a sectional view in a direction along the ejection groove 5*a*. This embodiment is different from the first embodiment in the structure of through holes 318. Wall Q2 of through holes 318 is a successive wall along wall Q1 of the ejection groove 5*a*. In other respects, the liquid jet head of this embodiment is similar to the first embodiment. Therefore, in the following description, points different from the first embodiment are mainly described and description of the same points is omitted. Like reference symbols are used to represent like members or members having like functions.

When ink flows to the discharge port 9 from the supply port 8 through the ejection groove 5*a* for this embodiment, ink flow can remove the air bubble stuck in through holes 318 and an air bubble can be discharged from the ejection groove 5*a* effectively. Because the wall Q2 is a successive wall along the wall Q1, the ink flow influences an air bubble effectively.

In addition, the wall Q1 may not be gentle inclination as shown in FIG. 17 and may be straight inclination. Moreover, a boundary of the wall Q1 and the wall Q2 doesn't need to continue.

What is claimed is:

1. A liquid jet head, comprising:

side walls forming grooves;

a reinforcing plate including through holes communicating with the grooves and being elongated in a longitudinal direction of the grooves, the reinforcing plate being formed of a ceramic material and placed below the side walls;

a nozzle plate including nozzles which are open to the through holes, the nozzle plate being placed on the reinforcing plate on a side opposite to the side walls;

drive electrodes formed on wall surfaces of the side walls; and a cover plate placed above the side walls, the cover plate comprising:

a supply port for supplying liquid to the grooves; and a discharge port for discharging liquid from the grooves.

2. A liquid jet head according to claim 1, wherein the ceramic material comprises machinable ceramic.

3. A liquid jet head according to claim 2, wherein: the cover plate is placed on upper surfaces of the side walls under a state in which upper surface ends in a longitudinal direction of the side walls are exposed; and wherein the liquid jet head further comprises extracting electrodes formed on the upper surface ends, the extracting electrodes being electrically connected to the drive electrodes.

4. A liquid jet head according to claim 2, further comprising sealing materials for closing the grooves outside communicating portions between the grooves and the supply port and between the grooves and the discharge port.

5. A liquid jet head according to claim 2, wherein the grooves comprise ejection grooves for ejecting liquid and dummy grooves which avoid ejecting liquid, the ejection grooves and the dummy grooves being alternately arranged relative one another.

6. A liquid jet apparatus, comprising: the liquid jet head according to claim 2; a moving mechanism for reciprocating the liquid jet head; a liquid supply tube for supplying liquid to the liquid jet head; and a liquid tank for supplying the liquid to the liquid supply tube.

7. A liquid jet head according to claim 1, wherein:

the cover plate is placed on upper surfaces of the side walls under a state in which upper surface ends in a longitudinal direction of the side walls are exposed; and the liquid jet head further comprises extracting electrodes formed on the upper surface ends, the extracting electrodes being electrically connected to the drive electrodes.

8. A liquid jet head according to claim 7, further comprising a flexible substrate having wiring electrodes formed on a surface thereof, wherein the flexible substrate is bonded to the upper surface ends and the wiring electrodes are electrically connected to the extracting electrodes.

9. A liquid jet head according to claim 1, further comprising sealing materials for closing the grooves outside communicating portions between the grooves and the supply port and between the grooves and the discharge port.

10. A liquid jet head according to claim 1, wherein:

the grooves comprise:

ejection grooves for ejecting liquid; and dummy grooves which avoid ejecting liquid, the ejection grooves and the dummy grooves being alternately arranged relative one another.

11. A liquid jet head according to claim 10, wherein the supply port and the discharge port are open to the ejection grooves and are closed to the dummy grooves.

12. A liquid jet apparatus, comprising:

the liquid jet head according to claim 1;

a moving mechanism for reciprocating the liquid jet head;

a liquid supply tube for supplying liquid to the liquid jet head; and a liquid tank for supplying the liquid to the liquid supply tube.

13. A liquid jet head according to claim 1, wherein each of the through holes of the reinforcing plate extends in the longitudinal direction of the grooves from at least an inner side surface of the supply port to an inner side surface of the discharge port.

14. A liquid jet head according to claim 13, wherein each of the through holes of the reinforcing plate has side surfaces aligned with the respective inner side surfaces of the supply port and the discharge port of the cover plate in a direction generally perpendicular to the longitudinal direction of the grooves.

15. A liquid jet head according to claim 13, wherein each of the supply port and the discharge port of the cover plate has opposite and confronting first and second inner side surfaces extending along a direction generally perpendicular to the longitudinal direction of the grooves, a distance between the first inner side surfaces of the supply port and discharge port in the direction generally perpendicular to the longitudinal direction of the grooves being less than a distance between the second inner side surfaces of the supply port and discharge port in the direction generally perpendicular to the longitudinal direction of the grooves; and wherein each of the through holes of the reinforcing plate has side surfaces aligned with the respective first inner side surfaces of the supply port and the discharge port.

16. A liquid jet head according to claim 13, wherein each of the supply port and the discharge port of the cover plate has opposite and confronting first and second inner side surfaces extending along a direction generally perpendicular to the longitudinal direction of the grooves, a distance between the first inner side surfaces of the supply port and discharge port in the direction generally perpendicular to the longitudinal direction of the grooves being less than a distance between the second inner side surfaces of the supply port and discharge port in the direction generally perpendicular to the longitudinal direction of the grooves; and wherein each of the through holes of the reinforcing plate has side surfaces aligned with the respective second inner side surfaces of the supply port and the discharge port.

17. A liquid jet head according to claim 13, wherein each of the supply port and the discharge port of the cover plate has opposite and confronting first and second inner side surfaces extending along a direction generally perpendicular to the longitudinal direction of the grooves, a first distance between the first inner side surfaces of the supply port and discharge port in the direction generally perpendicular to the longitudinal direction of the grooves being less than a second distance between the second inner side surfaces of the supply port and discharge port in the direction generally perpendicular to the longitudinal direction of the grooves; and wherein the width of each of the through holes of the reinforcing plate is greater than the second distance.

18. A liquid jet head comprising:

a plurality of side walls forming a plurality of ejection grooves for ejecting a liquid;

a plurality of drive electrodes formed on respective inner surfaces of the side walls;

a cover plate disposed over the side walls and having a supply port for supplying a liquid to the ejection grooves and a discharge port for discharging the liquid from the ejection grooves;

a nozzle plate having a plurality of nozzles for ejecting liquid supplied to the ejection grooves via the supply port of the cover plate; and a reinforcing plate disposed between the nozzle plate and the plurality of side walls, the reinforcing plate having a plurality of through holes communicating with the plurality of ejection grooves and with respective ones of the plurality of nozzles, the through holes being elongated in a longitudinal direction of the ejection grooves so that air bubbles present in the through holes are discharged from the ejection grooves during flow of the liquid to the discharge port from the supply port through the ejection grooves.

19. A liquid jet head according to claim 18, wherein each of the through holes of the reinforcing plate extends in the longitudinal direction of the ejection grooves from at least an inner side surface of the supply port to an inner side surface of the discharge port.

20. A liquid jet apparatus, comprising: the liquid jet head according to claim 18; a moving mechanism for reciprocating the liquid jet head; a liquid supply tube for supplying liquid to the liquid jet head; and a liquid tank for supplying the liquid to the liquid supply tube.

* * * * *